US011821198B2

(12) United States Patent
Cecchetto, Jr. et al.

(10) Patent No.: US 11,821,198 B2
(45) Date of Patent: Nov. 21, 2023

(54) PREFABRICATED BUILDING SYSTEM AND METHODS

(71) Applicants: Blach Construction Company, San Jose, CA (US); Gregory P. Luth & Associates, Inc., Santa Clara, CA (US); Quattrocchi Kwok Architects, Santa Rosa, CA (US)

(72) Inventors: Gino R. Cecchetto, Jr., Woodside, CA (US); Gregory P. Luth, San Jose, CA (US); Aaron R. Jobson, Santa Rosa, CA (US)

(73) Assignees: Blach Construction Company, San Jose, CA (US); Gregory P. Luth & Associates, Inc., Santa Clara, CA (US); Quattrocchi Kwok Architects, Santa Rosa, CA (US)

( * ) Notice: Subject to any disclaimer, the term of this patent is extended or adjusted under 35 U.S.C. 154(b) by 0 days.

(21) Appl. No.: 17/392,073

(22) Filed: Aug. 2, 2021

(65) Prior Publication Data

US 2022/0098851 A1 Mar. 31, 2022

Related U.S. Application Data

(63) Continuation of application No. 16/539,964, filed on Aug. 13, 2019, now Pat. No. 11,078,660.

(Continued)

(51) Int. Cl.

*E04B 1/35* (2006.01)
*E04B 1/348* (2006.01)

(Continued)

(52) U.S. Cl.

CPC ..... *E04B 1/35* (2013.01); *E02D 27/02* (2013.01); *E02D 27/08* (2013.01); *E04B 1/348* (2013.01);

(Continued)

(58) Field of Classification Search

CPC .... E04B 1/35; E04B 1/348; E04B 2001/3577; E04B 7/026; E04B 7/20; E04B 1/08;

(Continued)

(56) References Cited

U.S. PATENT DOCUMENTS 1,900,721 A 3/1933 Manske et al.
2,371,921 A 3/1945 Tucker (Continued)

FOREIGN PATENT DOCUMENTS

GB 1487244 A 9/1977
GB 1516300 A 7/1978
GB 2232427 A 12/1990

OTHER PUBLICATIONS

U.S. Patent and Trademark Office, Non-Final Office Action in U.S. Appl. No. 15/959,019, dated Oct. 18, 2018, 12 pages.

(Continued)

*Primary Examiner* — Rodney Mintz
(74) *Attorney, Agent, or Firm* — Kolisch Hartwell, P.C.

(57) ABSTRACT

A method of constructing a building is disclosed, including selecting a standard dimension less than a wide-load trucking permit limit and designing a building on a grid defined by the selected standard dimension. The building includes a plurality of prefabricated elements, wherein each prefabricated element has a width correspond to the selected standard dimension. The plurality of prefabricated elements includes a wall panel, a roof panel, a laterally resistive frame, and a rebar cage. The method includes fabricating each of the plurality of prefabricated elements at a manufacturing plant and transporting the elements by truck to a building site. The method includes constructing intersecting grade beam footings at the building site and pouring a slab between the intersecting grade beam footings. The grade beam footings include the rebar cage and have a uniform (Continued)

width and depth, the grade beam footings and the slab having contiguous upper surfaces.

19 Claims, 14 Drawing Sheets

Related U.S. Application Data

(60) Provisional application No. 62/718,310, filed on Aug. 13, 2018.

(51) Int. Cl.
*E02D 27/02* (2006.01)
*E02D 27/08* (2006.01)

(52) U.S. Cl.
CPC ..... *E02D 2250/0007* (2013.01); *E02D 2250/0023* (2013.01); *E02D 2300/002* (2013.01); *E04B 2001/3577* (2013.01)

(58) Field of Classification Search
CPC ..... E04B 1/2403; E04B 2001/2463; E04B 2001/2496; E02D 27/02; E02D 27/08; E02D 2300/002; E02D 2250/0023; E02D 2250/0007
See application file for complete search history.

(56) References Cited

U.S. PATENT DOCUMENTS 2,856,646 A 10/1958 Latimer et al.
3,110,131 A 11/1963 Jeffress
3,172,507 A 3/1965 Blyveis
3,368,016 A 2/1968 Birguer
3,849,012 A 11/1974 Krouse
3,994,107 A 11/1976 Aughuet
4,071,988 A 2/1978 Bowes
4,073,107 A 2/1978 Rousseau
4,075,814 A * 2/1978 Theurer ..... E04B 1/34823 52/79.5
4,141,188 A 2/1979 Sukolics
4,192,481 A 3/1980 Durbin
4,194,333 A 3/1980 Paton et al.
4,398,378 A 8/1983 Heitzman
4,506,482 A 3/1985 Pracht et al.
4,563,851 A 1/1986 Long
4,905,444 A 3/1990 Semaan et al.
5,617,685 A 4/1997 Meier et al.
6,003,280 A 12/1999 Wells
6,058,668 A 5/2000 Herren
6,216,405 B1 4/2001 Smith
6,240,682 B1 6/2001 James et al.
6,470,644 B2 10/2002 James et al.
6,503,025 B1 1/2003 Miller
6,550,213 B1 4/2003 Butler
7,325,362 B1 * 2/2008 Rowland ..... E04C 3/11 52/93.2
7,596,923 B1 10/2009 Thomas et al.
7,665,251 B1 * 2/2010 Lang ..... E04B 5/10 52/93.2
7,802,406 B2 9/2010 Simmons
7,866,108 B2 1/2011 Klein
8,312,678 B1 11/2012 Haddock
8,474,220 B2 7/2013 Svensson
8,528,296 B1 9/2013 Miller
8,555,592 B2 10/2013 Daudet et al.
8,763,328 B2 7/2014 Tuttle
9,032,681 B1 5/2015 Brady
9,663,961 B2 5/2017 Moeller et al.
9,915,064 B1 3/2018 Sanders et al.
10,119,265 B2 * 11/2018 Higgins ..... E04B 1/2608
10,196,808 B1 2/2019 Gibbs et al.
10,260,228 B2 * 4/2019 King ..... E04B 1/34321
10,544,584 B2 1/2020 Cecchetto, Jr. et al.
10,544,585 B2 1/2020 Cecchetto, Jr. et al.
10,550,565 B2 2/2020 Heatly
10,584,479 B2 3/2020 Saenz Saenz
10,731,329 B1 * 8/2020 Novikov ..... E04B 1/3483
11,078,660 B2 * 8/2021 Cecchetto, Jr. ..... E02D 27/02
11,142,900 B2 * 10/2021 Ishaq ..... E04B 1/08
2001/0025458 A1 10/2001 James et al.
2003/0131544 A1 7/2003 Miller
2003/0233798 A1 12/2003 Berkey et al.
2005/0252149 A1 11/2005 Ritchey et al.
2008/0222976 A1 9/2008 Liskey
2010/0115880 A1 5/2010 Svensson
2011/0203217 A1 8/2011 Dayton et al.
2017/0130444 A1 * 5/2017 Higgins ..... E04B 1/2608
2018/0163391 A1 * 6/2018 King ..... E04H 1/02
2018/0305925 A1 10/2018 Cecchetto, Jr. et al.
2018/0328034 A1 11/2018 Cecchetto, Jr. et al.
2018/0371742 A1 12/2018 Saenz Saenz
2019/0010700 A1 1/2019 Webb et al.
2019/0257081 A1 8/2019 Heatly
2020/0048892 A1 * 2/2020 Cecchetto, Jr. ..... E02D 27/02
2021/0087773 A1 3/2021 Lim
2022/0136229 A1 * 5/2022 Tompane ..... E04B 2/70 52/633
2022/0136241 A1 * 5/2022 Tompane ..... E04B 1/2612 52/653.1
2022/0213684 A1 * 7/2022 Besjak ..... E04C 2/50

OTHER PUBLICATIONS

U.S. Patent and Trademark Office, Non-Final Office Action in U.S. Appl. No. 15/959,019, dated May 15, 2019, 8 pages.
U.S. Patent and Trademark Office, Non-Final Office Action regarding U.S. Appl. No. 15/975,089, dated May 22, 2019, 10 pages.
U.S. Patent and Trademark Office, Non-Final Office Action regarding U.S. Appl. No. 16/773,820 dated Jul. 31, 2020, 13 pages.
U.S. Patent and Trademark Office, Non-Final Office Action in U.S. Appl. No. 16/773,665, dated Oct. 7, 2020, 17 pages.
U.S. Patent and Trademark Office, Final Office Action regarding U.S. Appl. No. 16/773,820, dated Nov. 17, 2020, 16 pages.
U.S. Patent and Trademark Office, Final Office Action regarding U.S. Appl. No. 16/539,964, dated Nov. 24, 2020, 16 pages.
U.S. Patent and Trademark Office, Final Office Action regarding U.S. Appl. No. 16/773,665 dated Jan. 21, 2021, 26 pages.
U.S. Patent and Trademark Office, Final Office Action regarding U.S. Appl. No. 16/773,665, filed Dec. 10, 2021, 9 pages.

* cited by examiner

PREFABRICATED BUILDING SYSTEM AND METHODS

CROSS-REFERENCES

This application is a continuation of U.S. patent application Ser. No. 16/539,964 filed Aug. 13, 2019, which claims priority from U.S. Provisional Patent Application Ser. No. 62/718,310, filed Aug. 13, 2018. The complete disclosures of each application are hereby incorporated by reference in their entireties for all purposes. Also hereby incorporated by reference for all purposes are U.S. Patent Application Publication No. 2018/0305925 and U.S. Patent Application Publication No. 2018/0328034.

BACKGROUND

Many buildings have floor plans that are consistently standardized and replicated throughout the structure, such as student housing or multifamily housing, classroom buildings, and medical office buildings. These types of buildings lend themselves to off-site prefabrication, which may dramatically accelerate on-site construction schedules and improve on-site safety, while simultaneously providing improved quality and precision of materials and reducing costs.

SUMMARY

The present disclosure provides systems, apparatuses, and methods relating to constructing a building including a plurality of prefabricated elements. In some examples, a method of constructing a building may include selecting a standard dimension which is less than a wide-load trucking permit limit and designing a building on a grid defined by the selected standard dimension. The building may include a plurality of prefabricated elements, wherein each prefabricated element has a width corresponding to the selected standard dimension. The plurality of prefabricated elements may include a wall panel, a roof panel, a braced frame, and a rebar cage, among other elements. The method may further include fabricating each of the plurality of prefabricated elements at a manufacturing plant and transporting the plurality of prefabricated elements by truck from the manufacturing plant to a building site. The method may further include constructing intersecting grade beam footings at the building site and pouring a slab between the intersecting grade beam footings. The grade beam footings may include the rebar cage and have a uniform width and depth, the grade beam footings and the slab having contiguous upper surfaces.

In some examples, a method of constructing a building may include prefabricating a braced frame, prefabricating a rebar cage, and transporting the braced frame and the rebar cage to a construction site. The braced frame may include a column component and a diagonal brace component. The method may further include constructing intersecting grade beam footings at the construction site, the grade beam footings having a uniform width and depth and including the rebar cage. The column component of the braced frame may extend into at least one of the grade beam footings.

In some examples, a building assembly may include a foundation and a slab. The foundation may include intersecting grade beam footings having a uniform width and depth. The slab may extend between grade beam footings, wherein the slab and grade beam footings have coplanar upper surfaces.

Features, functions, and advantages may be achieved independently in various examples of the present disclosure, or may be combined in yet other examples, further details of which can be seen with reference to the following description and drawings.

DETAILED DESCRIPTION

Various aspects and examples of a method of constructing a building, as well as related buildings assemblies, are described below and illustrated in the associated drawings. Unless otherwise specified, a building assembly in accordance with the present teachings, and/or its various components may, but are not required to, contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed examples. The following description of various examples is merely illustrative in nature and is in no way intended to limit the disclosure, its application, or uses. Additionally, the advantages provided by the examples described below are illustrative in nature and not all examples provide the same advantages or the same degree of advantages.

This Detailed Description includes the following sections, which follow immediately below: (1) Overview; (2) Examples, Components, and Alternatives; (3) Illustrative Combinations and Additional Examples; (4) Advantages, Features, and Benefits; and (5) Conclusion. The Examples, Components, and Alternatives section is further divided into subsections A-C, each of which is labeled accordingly.

Overview

Figure 1:
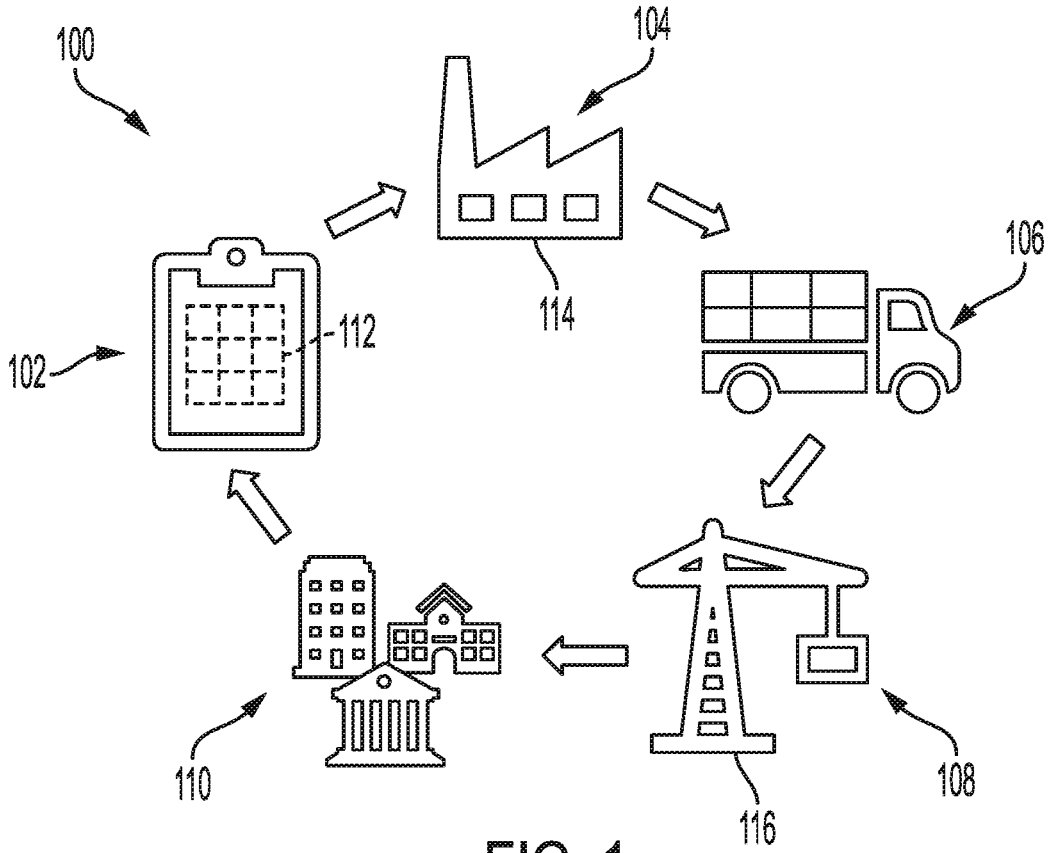
FIG. 1 is a schematic diagram of an illustrative method of design and construction of a grid-based building with prefabricated elements.

In general, a method of constructing a building including a plurality of prefabricated elements may include designing the building according to a grid with a selected standard width and prefabricating elements having a width corresponding to the selected standard width. FIG. 1 is a schematic diagram of an illustrative method 100 of constructing such a building. Method 100 includes five phases, a design phase 102, a prefabrication phase 104, a transportation phase 106, an assembly phase 108, and a finishing phase 110.

Design phase 102 may include selecting a standard width of a grid 112. The standard width may be selected according to transportation constraints. For example, the standard width may be selected to be less than a standard trucking permit width limit. For another example, the standard width may be selected to be less than a width of a truck bed of a transportation company or construction company's vehicle fleet.

Design phase 102 may further include designing the building along grid 112. For example, columns may be located at grid-line intersections and beams may be centered along grid lines. The building may be designed to be constructible primarily of prefabricated and/or panelized elements having a width matching the selected standard width. The foundation of the building may also be designed along grid 112. For example, the foundation may include intersecting grade beams extending along the grid lines. Rebar for the footing may be designed for prefabrication as cages.

Where exceptions to the grid size are necessary or desirable, deviations may be designed to allow use of prefabricated elements having a width less than the selected standard width. For example, in designing a room larger than the standard width and less than twice the standard width, two wall panels may be used, each having a width less than the standard width.

Design phase 102 may further include designing the building frame and panelized elements to be constructible without on-site welding. For example, laterally resistive frames of the building may be designed to set into the foundation such that welding of steel drag anchors is not required. For another example, roof and wall panels may be designed for erection at a construction site using connection systems including fasteners and without welding to the building frame or between panels. Such systemic and exhaustive elimination of on-site welding may reduce construction time by weeks or months, resulting in dramatic cost savings.

Design phase 102 may further include designing the building to facilitate incorporation of other prefabricated systems and/or elements. The building design may include both custom prefabricated elements and support for predesigned systems such as commercially available prefabricated systems. For example, wall panels and/or the building frame may be configured to allow connection of a prefabricated glazing system. For another example, floor plan and foundation designs may be made to accommodate a modular prefabricated elevator assembly.

Once a building design has been developed, the prefabricated elements of the building may be manufactured in prefabrication phase 104. The prefabrication phase may be performed at a factory or manufacturing plant 114. Manufacturing plant 114 may be an indoor facility used for manufacture of building materials and/or components under controlled conditions. Manufacturing plant 114 may provide consistent conditions, oversight, quality control, and automation among other advantages not available when fabricating materials and components in the field. Such advantages may in turn lower production costs and improve quality. Other advantages include eliminating weather conditions such as rain, wind, and heat, which may enhance worker safety and further improve quality. Increased precision and quality in the manufacturing process may in turn increase the overall quality of the constructed building.

Prefabrication phase 104 may be carried out prior to breaking ground at a construction site for the building. Completion of the prefabrication phase prior to assembly phase 108 may ensure that all prefabricated elements are ready when required, eliminate fabrication from the on-site construction schedule, and prevent potential costly delays. In some examples, some or all of prefabrication phase 104 may be performed concurrently with on-site utility and/or preparatory work. Such concurrent work may also eliminate fabrication from the on-site construction schedule and reduce overall construction time.

Transportation phase 106 may include transporting the prefabricated elements to a construction site 116. The prefabricated elements may preferably be transported by truck or other low-cost method. The dimensions of the prefabricated elements, as determined in design phase 102 may allow the prefabricated elements to be transported without special equipment, wide-load permits, or other special arrangements.

Assembly phase 108 may include erecting the prefabricated elements at construction site 116. The prefabricated elements may be configured for erection by fastening together, with minimal to no welding. For example, laterally resistive frames such as braced or moment frames may be configured to set as columns, and roof and wall panels may be configured to bolt to the building frame. Such elimination of welding at construction site 116 and prefabrication of building components may significantly improve construction efficiency and reduce on-site construction time, which may in turn dramatically reduce overall building cost.

Excavation and/or pouring of foundations may be performed prior to assembly phase 108, or as part of the assembly phase. Design of the foundation in phase 102, according to grid 112, may also improve speed and efficiency of construction. The footings may be designed with a consistent width and depth, in a linear or ladder-style layout. Such design may be dug in a single pass and/or with a single bucket, and may require a minimum of maneuvering of excavation equipment. Prefabricated rebar cages may eliminate on-site tying of rebar, and limit worker time in the excavations. The efficient layout of the ladder-style foundation may reduce labor and associated costs, and simplify the rebar system which may reduce both material and labor costs.

Finishing phase 110 may include non-structural work on the building, such as installation of external wall cladding, internal walls, and subcontractor work such as mechanical, electrical, and plumbing (MEP). The finished building may be of any type, including medical, academic, institutional, office, financial, or residential. The building may be single or multi-story and may be configured to comply with local code requirements such as seismic code.

Once the building has been completed, the building design may be modified and re-used. For example, a university with campuses in multiple cities may follow method 100 for efficient and high-quality construction of a classroom building in a first location. Returning to design phase 102, the original building design may be modified to comply with regulations specific to a new city. For example, seismic tolerance may be increased, the standard width of grid 112 may be slightly adjusted according to a more restrictive trucking permit width limit, or classroom sizes may be altered to comply with local code requirements. Such redesign may be a significant saving in time and cost over a new design for each campus, while allowing flexibility to adapt to constraints specific to each building.

Similarly, a basic floorplan configuration may be useful for different types of buildings, for example, schools, hospitals, or hotels, subject to purpose-specific finishing detail variations. Structural redundancy may also result in reduction of engineering and architectural costs.

Examples, Components, and Alternatives

The following sections describe selected aspects of exemplary methods of constructing a building including a plurality of prefabricated elements as well as related systems and/or assemblies. The examples in these sections are intended for illustration and should not be interpreted as limiting the entire scope of the present disclosure. Each section may include one or more distinct examples, and/or contextual or related information, function, and/or structure.

A. Illustrative Building

Figure 2:
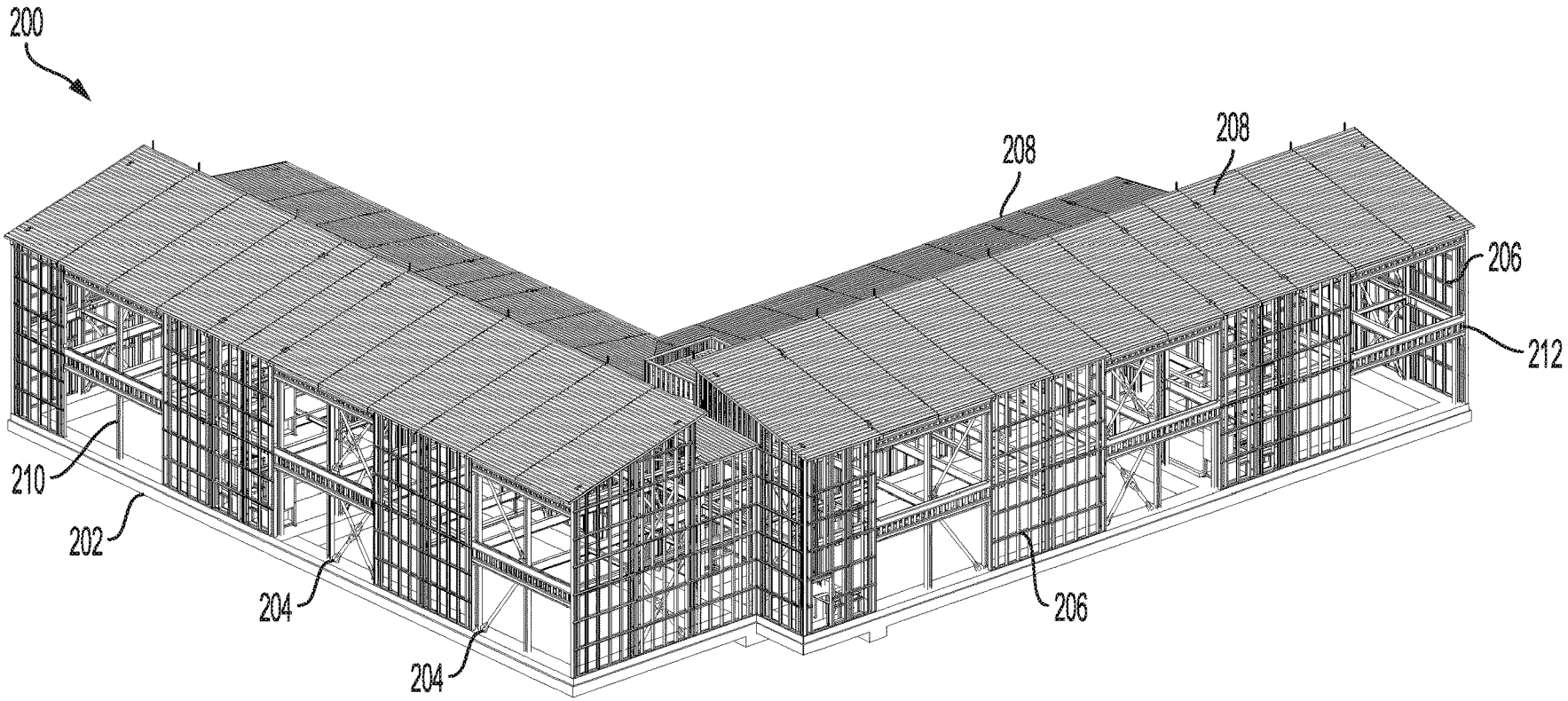
FIG. 2 is an isometric view of an illustrative building assembly, as described herein.

As shown in FIGS. 2-12, this section describes an illustrative building 200. Building 200 is an example of a grid-based building with prefabricated and panelized elements, as described above. As shown in FIG. 2, building 200 is two-story and includes a grade beam foundation 202, prefabricated laterally resistive frames 204, balloon-framed light-gauge exterior wall panels 206, and steel and pan deck roof panels 208, in addition to structural steel columns 210 and beams 212 and a composite concrete second floor deck.

Building 200 further includes a prefabricated staircase system 209, a prefabricated glazing system, and a modular elevator assembly. The frame of building 200 may be designed to allow lifting of staircase system 209 and/or the modular elevator assembly through the roof. The modular elevator, prefabricated off-site, may be thereby installed in as little as one day.

Figure 3:
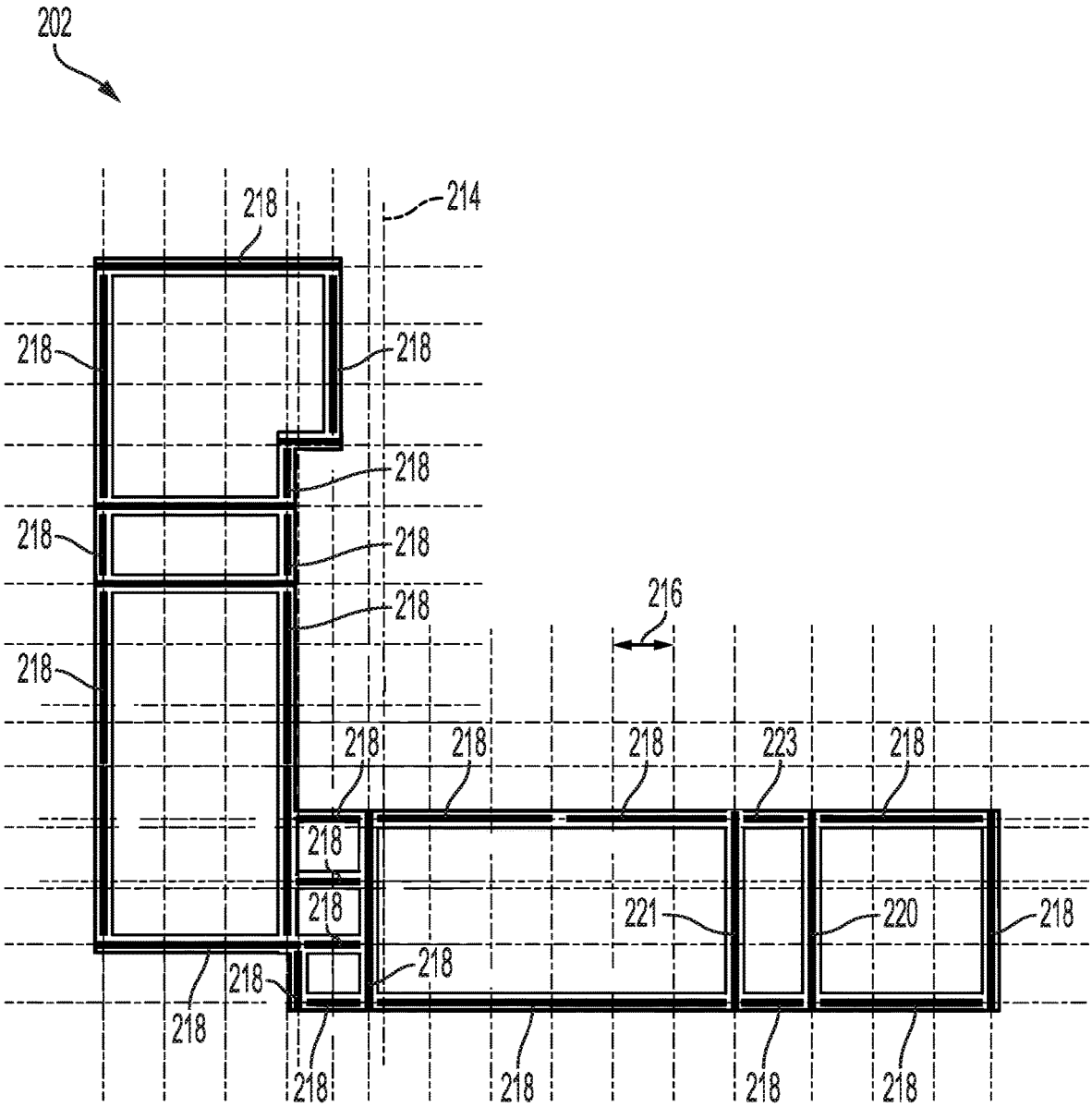
FIG. 3 is a plan view of a foundation of the building assembly of FIG. 2, including a reference grid.

As shown in FIG. 3, foundation 202 is laid out according to a grid 214. The grid has a standard spacing 216. In the present example, standard spacing 216 is ten feet and one eighth inches. In general, the standard spacing may be selected to be less than a standard trucking permit width limit. The standard spacing may also be selected to allow gaps to be provided between prefabricated elements. That is, the standard spacing of grid 214 may be greater than an intended nominal width of prefabricated elements such as wall panels 206 or roof panels 208. This may allow for production variation of the prefabricated elements and/or growth or clearance loss between the prefabricated elements during erection. Any remaining gaps may later be sealed.

Foundation 202 is composed of intersecting grade beam footings 218. The grade beams each lie along a grid line of grid 214. Grade beams 218 vary in length, but each grade beam 218 has the same width and depth. This may simplify excavation required for construction of foundation 202. For example, each grade beam may have a width between three feet and four feet and a depth between two and three feet. Such dimensions may enable use of a typical excavation bucket. The interconnected grade beams may improve structural integrity and resist uplift, which may lead to a more economical and robust lateral system as compared to conventional spread footings.

Figure 4:
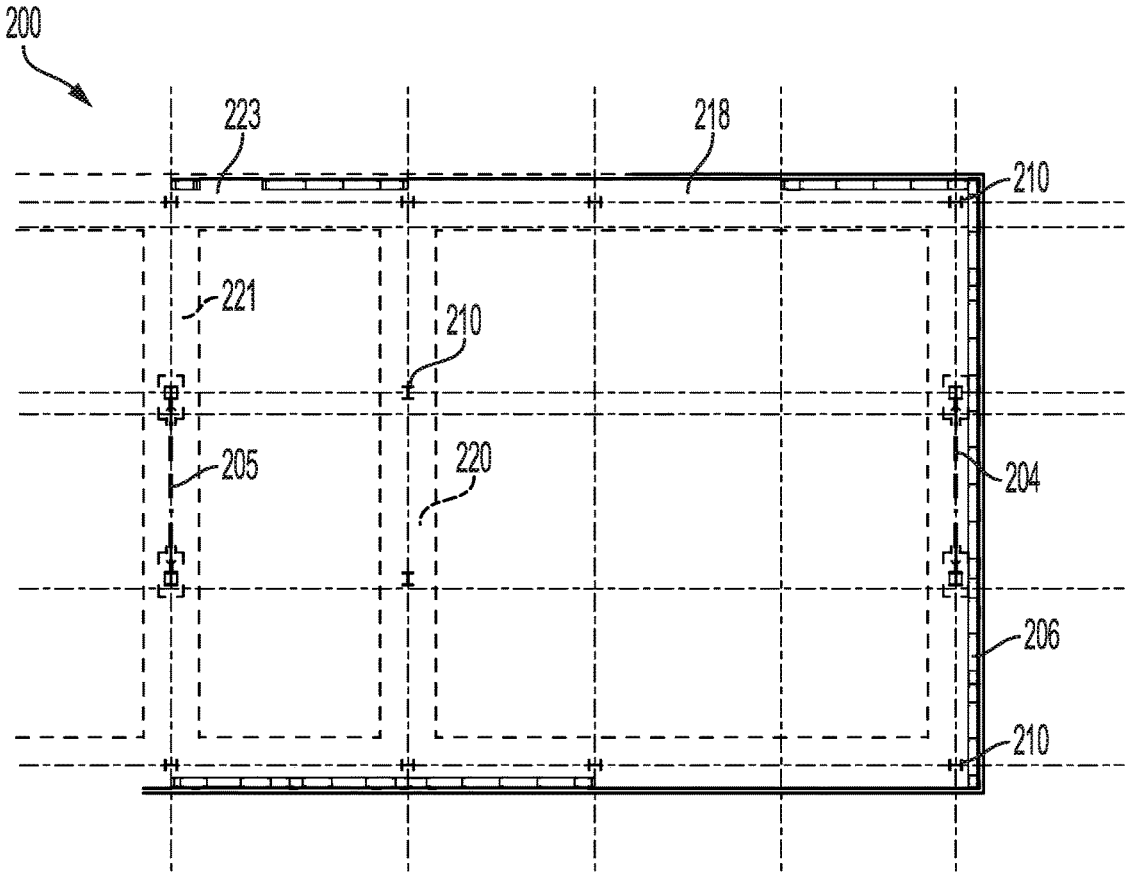
FIG. 4 is a plan view of a portion of the building assembly of FIG. 2, including the reference grid.

FIG. 4 shows a plan view of a portion of building 200, including foundation 202, laterally resistive frames 204, columns 210, and wall panels 206. Also depicted is grid 214. Columns 210 are located at grid intersections, and each laterally resistive frame 204 extends between two grid intersections. The columns and laterally resistive frames are aligned over grade beams 218 of foundation 202.

Figure 5:
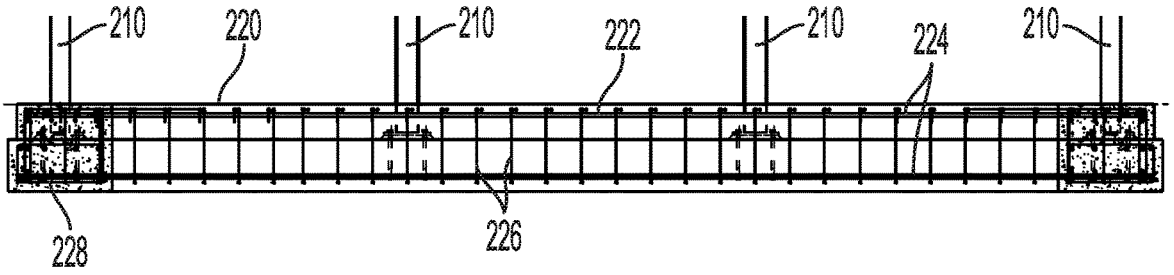
FIG. 5 is an elevation view of a grade beam of the foundation of the building assembly of FIG. 2, including a prefabricated rebar cage.

Foundation 202 includes a first grade beam 220, a second grade beam 221, and a third grade beam 223 spanning between the first and second grade beams. FIG. 5 is an elevation view of first grade beam 220, showing a first prefabricated rebar cage 222. Rebar cage 222 includes a plurality of lateral bars 224 and a plurality of stirrups 226. The linear footings allow use of linear rebar cages which can be prefabricated off-site and then simply dropped into place. The footing may be designed according to the ends of the rebar cages, such that interruptions in the rebar occur at points of minimum stress.

Figure 6:
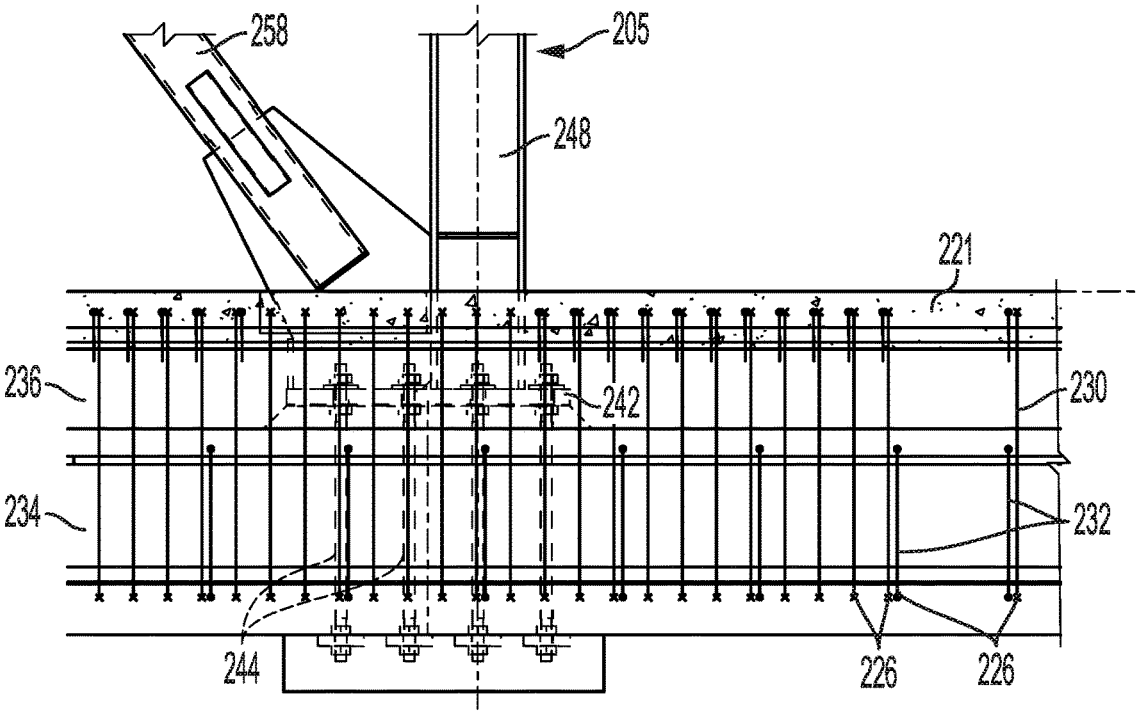
FIG. 6 is a detail view of a grade beam and a braced frame of the building assembly of FIG. 2.

Each grade beam of foundation 202 includes a prefabricated rebar cage, and each cage has the same height and width. The length of the rebar cage varies to match the length of the grade beam. The spacing of stirrups 226 varies depending on the structural steel connections to the respective grade beam. Rebar cage 222 includes evenly spaced stirrups 226, because only individual columns 210 are set into first grade beam 220. As shown in FIG. 6, the density or number of stirrups 226 varies in the rebar cage of second grade beam 221, as described further below.

Referring again to FIG. 5, a second prefabricated rebar cage 228 in intersecting third grade beam 223 is shown end-on. When the rebar for foundation 202 is installed, first and second rebar cages 222, 228 may be placed in the footing excavations for the first and third grade beams. The two cages may then be doweled together with small bars. These connecting bars may be selected according to applicable code requirements and cut to length during prefabrication, then included with the prefabricated rebar cages for shipment. For example, the connecting bars may be temporarily wired inside the rebar cages. Once the rebar cage is placed, the connecting bars may be released and moved only a small distance to form the connection between cages. The rebar cages of each pair of intersecting grade beams may be similarly connected.

FIG. 6 is a detail view of second grade beam 221 and a connected braced frame 205. Second grade beam 221 includes a rebar cage 230. The spacing or density of stirrups 226 varies along cage 230. The density of stirrups is increased under braced frame 205, to accommodate the greater load transfer from the frame. In some locations, the cage further includes reinforcing u-shaped bars 232. Rebar cage 230 or any of the rebar cages of foundation 202 may include additional reinforcements or other features as needed to provide desired structural properties to the respective grade beam 218.

Figure 7:
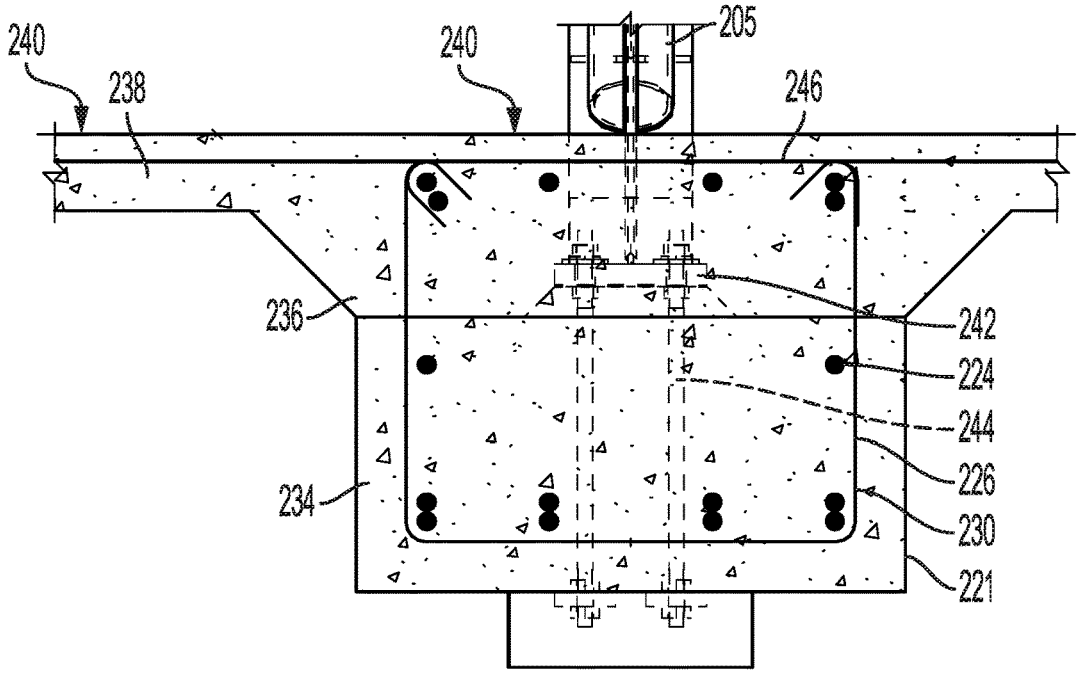
FIG. 7 is a cross-sectional detail view of the grade beam and braced frame of FIG. 6.

FIG. 7 is a cross-sectional view of second grade beam 221 and braced frame 205, which shows more clearly a lower portion 234 and an upper portion 236 of grade beam 221. The lower portion may be formed by a first pour of concrete, and the upper portion may be formed by a second pour of concrete. Each grade beam 218 of foundation 202 may be similarly formed, and the following description may be understood to apply to each grade beam.

FIG. 7 also shows a slab 238, which is contiguous with upper portion 236 of grade beam 221. Slab 238, which may be referred to as a floor slab or ground-bearing slab, may be the floor, sub-floor and/or floor support of the ground level of the building. Slab 238 is also formed by the second pour of concrete. That is, slab 238 and upper portion 236 of grade beam 221 are formed with the same concrete pour. A separate concrete pour to form the slab is not required, unlike in traditional concrete foundations. The excavation depth for grade beam 221 may be therefore reduced, requiring less time to dig and generating less off-haul soil. The reduced number of pours required may also improve foundation construction time.

Slab 238 and grade beam 221 each have a planar upper surface 240. Upper surface 240 of grade beam 221 is coplanar and contiguous with upper surface 240 of slab 238. Rebar cage 230 of grade beam 221 extends through both lower portion 234 and upper portion 236 of the grade beam. In effect, the rebar of the grade beam extends into the slab. Slab 238 is thereby mobilized as part of foundation 202. This structural functionality of the slab may eliminate the need for structural steel drag anchors, which may in turn streamline construction and eliminate associated on-site welding.

Braced frame 205 also extends into upper portion 236 of grade beam 221, as shown more clearly in FIG. 6. The braced frame is bolted to a base plate 242 by a plurality of anchor bolts 244. Anchor bolts 244 extend up through lower portion 234 of grade beam 221, through base plate 242 and into upper portion 236 of the grade beam. Base plate 242 is disposed in upper portion 236.

When forming grade beam 221, templates for anchor bolts 244 may be positioned when rebar cage 230 is set into the excavation for the grade beam. Before the second pour is made, the templates may be replaced with anchor bolts 244, base plate 242 may be connected to the anchor bolts, and braced frame 205 may be erected and bolted to the base plate. Once braced frame 205 is set, the second pour may be made over the bolted connection.

To allow placement of base plate 242 and setting of braced frame 205, those stirrups 226 of rebar cage 230 proximate the braced frame may include a separable cap section 246. The cap section may be wired onto rebar cage 230 for transportation and then released when base plate 242 is installed. Once braced frame 205 is set, cap section 246 may be replaced to complete stirrup 226 prior to the second concrete pour.

Figure 16:
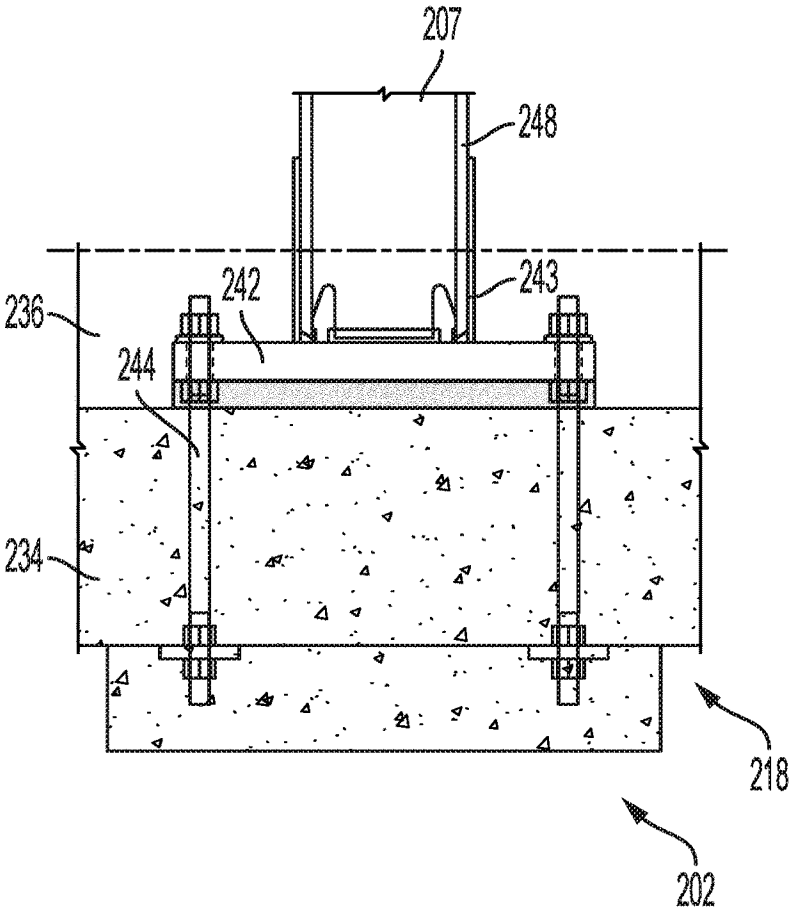
FIG. 16 is a cross-sectional detail view of a grade beam and the moment frame of FIG. 15.

An individual unbraced column 210 may be similarly erected (see FIG. 5). Other types of laterally resistive frames such as a moment frame may also be similarly erected. FIG. 16 is a cross-sectional view of another grade beam 218 and a moment frame 207. Moment frame 207 also extends into upper portion 236 of grade beam 218. The moment frame and a stiffener 243 are bolted to a base plate 242 by a plurality of anchor bolts 244. Anchor bolts 244 extend up through lower portion 234 of grade beam 218, through base plate 242 and into upper portion 236 of the grade beam. Base plate 242 is disposed in upper portion 236.

In typical foundations, building frame members may be bolted at the top of a grade beam footing, outside of the footing. A significant portion of the loads may therefore be transferred through the bolts, requiring larger bolts, a greater number of bolts, and/or drag anchors to accommodate the loads. In the present example, encasement of the bases of the lateral resisting elements allows forces from seismic, wind, and other load sources to be transferred directly from the building frame to the slab in bearing, and from the slab to the foundation through shear enabled by the shear dowels. This may eliminate the need for additional steel fabrications to perform the load transfer function.

In other words, embedding laterally resistive frames and columns directly into the grade beams may improve transfer of forces between the structural steel frame and the foundation of the building. Together with the mobilization of the slab as part of the foundation, this structure may provide a highly effective foundation while reducing wasted concrete, simplifying excavation, and reducing construction time.

Laterally resistive frames 204 of the building may include braced frames, moment frames, and/or any equivalently effective laterally resisting system. Irrespective of the frame type, each laterally resistive frame may be fully prefabricated in the shop or factory, and may not require any on-site welding during erection.

Figure 8:
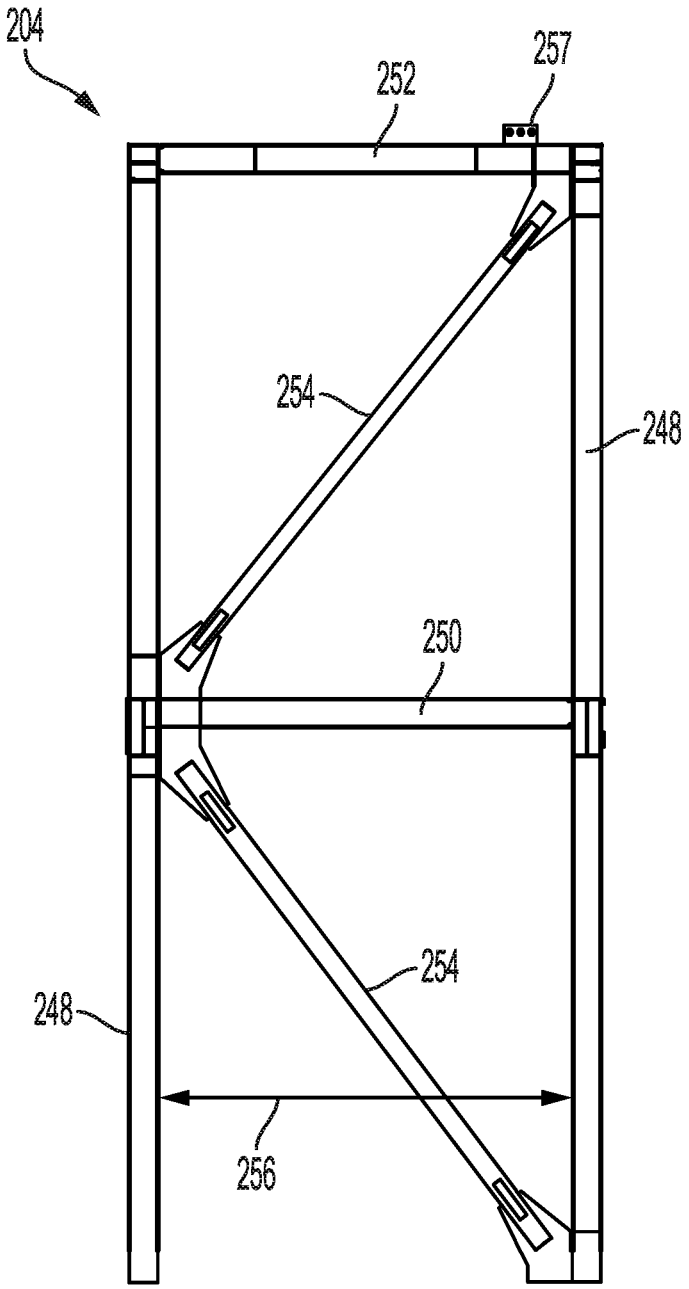
FIG. 8 is an elevation view of a braced frame of the building assembly of FIG. 2.

FIG. 8 shows a prefabricated braced frame 203. Braced frame 203 includes two parallel vertical members 248, and two horizontal members extending between the vertical members. The horizontal members include a central beam 250 and an upper beam 252. The braced frame further includes two diagonal braces 254. The braces of each braced frame may vary according to the structural requirements at the respective location in the building. Braced frame 203 further includes a plate 257 configured for connection of roof panels, as described further below.

All elements of the braced frame are fabricated and assembled prior to shipping to the building site. That is, vertical members 248, diagonal braces 254, central beam 250, and upper beam 252 are all fabricated and welded together to complete braced frame 203. Such prefabrication of braced frame 203 may eliminate on-site welding, improving quality of the braced frame and dramatically reducing installation time in the field. As compared to a traditional braced frame field assembled and field welded from prefabricated pieces, braced frame 203 may be erected in under an hour instead of over the course of multiple days. The braced frame may be described as setting like a column.

Braced frame 203 has a width 256. The width is selected to match standard spacing 216 of grid 214 of building 200, see FIG. 3. In the present example, width 256 is ten feet. This width matches standard spacing 216 of ten feet and one eighth inches with a gap for clearance loss during erection, as described above. Braced frame 203 may therefore be transported to the building site under a standard trucking permit, without need for special permits or other special provisions.

Figure 15:
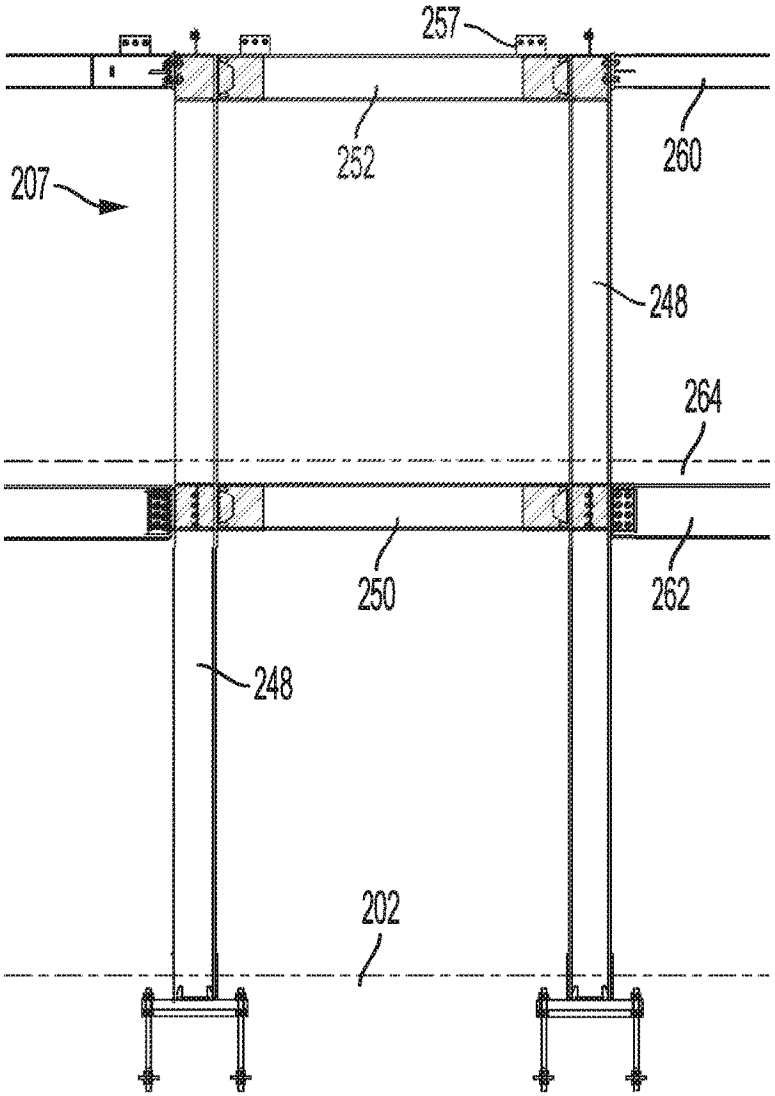
FIG. 15 is an elevation view of an illustrative moment frame.

FIG. 15 shows a prefabricated moment frame 207. Moment frame 207 includes two parallel vertical members 248, and two horizontal members extending between the vertical members. The horizontal members include a central beam 250 and an upper beam 252. The central and upper beams may be larger than those of braced frame 203, and may be described as horizontal braces. In some examples, moment frame 207 may be preferable over braced frame 203 for interior supports of the building, allowing open-plan designs and movement of occupants through the frame. Moment frame 207 further includes a plate 257 configured for connection of roof panels, as described further below.

All elements of the moment frame are fabricated and assembled prior to shipping to the building site. That is, vertical members 248, central beam 250, and upper beam 252 are all fabricated and welded together to complete moment frame 207. Such prefabrication of the moment frame may eliminate on-site welding, improving quality of the moment frame and dramatically reducing installation time in the field. As compared to a traditional moment frame, field assembled and field welded from prefabricated pieces, moment frame 207 may be erected in under an hour instead of over the course of multiple days. The moment frame may be described as setting like a column.

Moment frame 207 has a width 256. The width is selected to match standard spacing 216 of grid 214 of building 200, as shown in FIG. 3. In the present example, width 256 is ten feet. This width matches standard spacing 216 of ten feet and one eighth inches with a gap for clearance loss during erection, as described above. Moment frame 207 may therefore be transported to the building site under a standard trucking permit, without need for special permits or other special provisions.

Braced frame 203 and moment frame 207 may be smaller than typical laterally resistive frames. Building 200 may accordingly include a greater number of laterally resistive frames to achieve an equivalent structural strength. However, the smaller size of braced frame 203 and moment frame 207 may reduce the number of bolts required at the base plate, and not require drag anchors. The greater number of braced frames in the building may provide additional redundancy, and an improved structure. Braced frame 203 may also be positioned to take advantage of the continuity of the interconnected grade beams of the building foundation.

Figure 9:
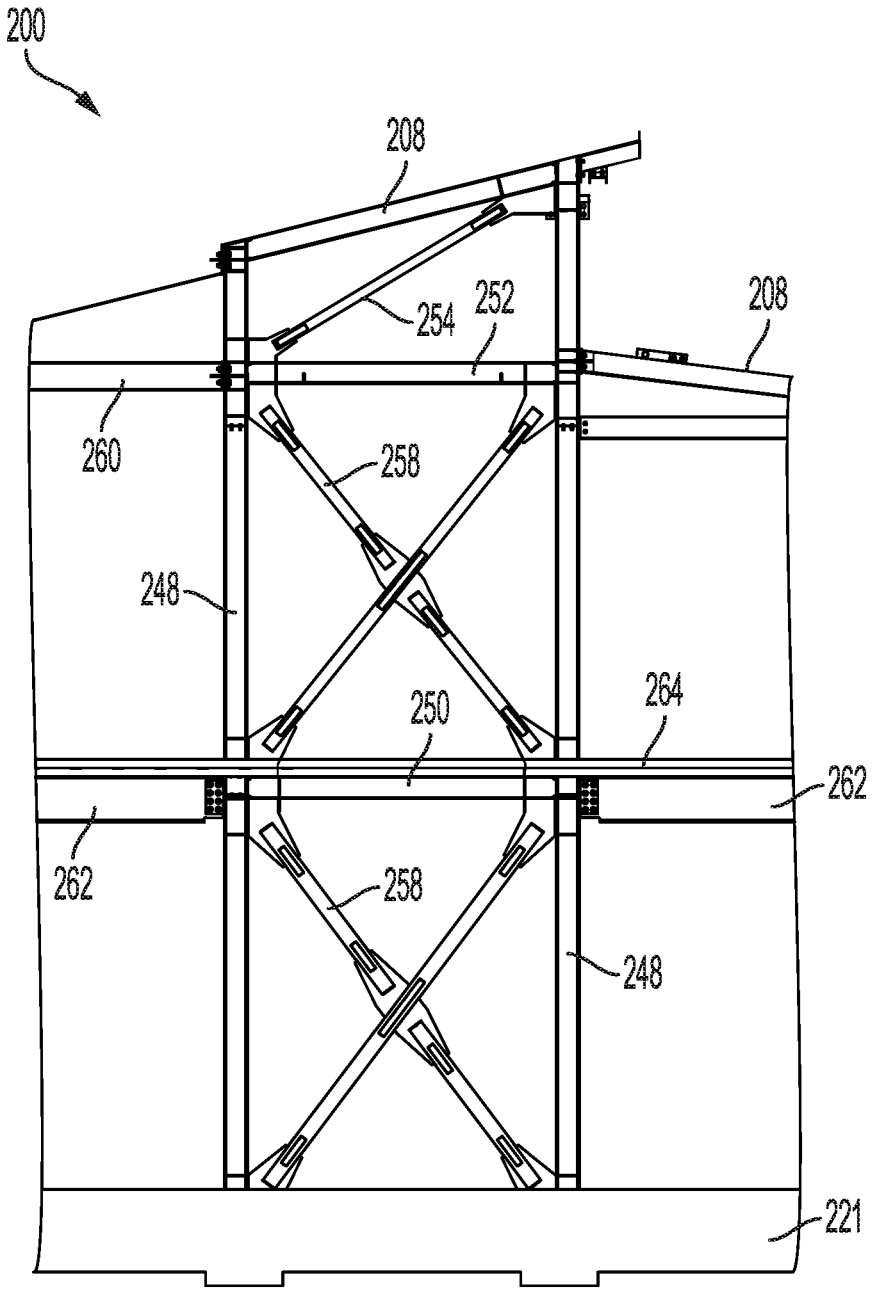
FIG. 9 is an elevation view of another braced frame of the building assembly of FIG. 2, installed in the building assembly.
Figure 10:
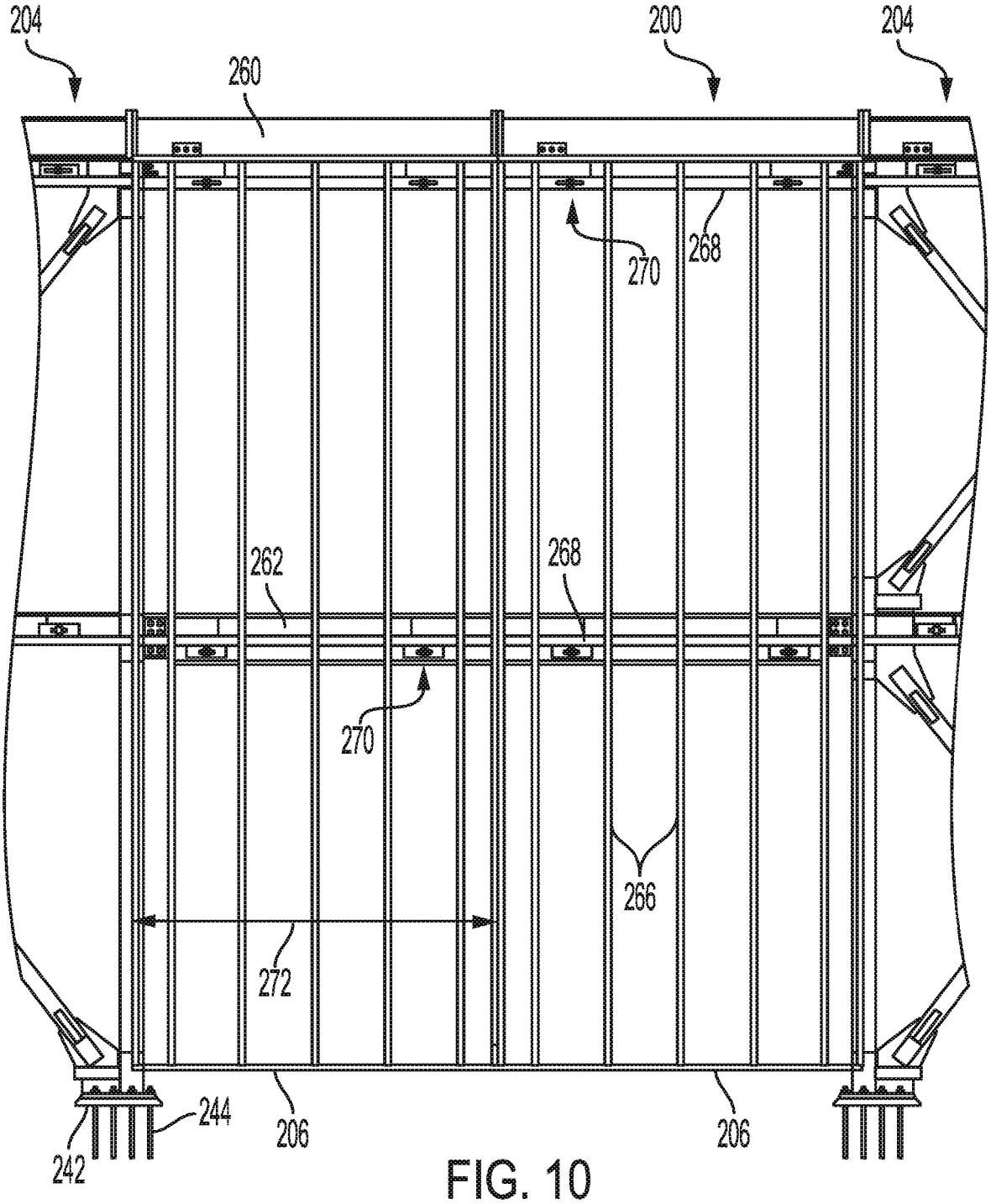
FIG. 10 is an elevation view of a wall panel of the building assembly of FIG. 2, installed in the building assembly.

FIG. 9 shows braced frame 205 as set into grade beam 221 and connected with the rest of the erected steel frame of building 200. Braced frame 205 includes cross-shaped braces 258 instead of the diagonal braces as shown in FIG. 8, for additional structural strength. Vertical members 248 of braced frame 205 also extend past upper beam 252 asymmetrically to define the pitch of an upper roof of the building and support a roof panel 208. A diagonal brace 254 extends between the vertical members above upper beam 252. Another roof panel 208 is connected to one of vertical members 248 proximate upper beam 252, to form a lower roof of the building. A roof beam 260 is connected to the other vertical member 248, proximate upper beam 252. A floor beam 262 is attached to each of vertical members 248, proximate central beam 250. Together the floor beams and central beam support a floor 264. Each vertical member 248 is embedded in grade beam 221 and bolted to a base plate 254. A lower one of cross-shaped braces 258 is similarly embedded in the grade beam and bolted to the base plates. FIG. 10 shows a pair of wall panels 206, bolted to a floor beam 262 and a roof beam 260. The wall panels may also be bolted and/or otherwise anchored into the concrete of the building foundation. Rebar cages of the grade beam footings may be configured and/or placed to facilitate such anchoring. A plurality of wall panels may be connected together by fastener assemblies to form the exterior walls the building. Each wall panel may be connected to the building frame and to one or more adjacent wall panels.

Wall panels 206 may be any modular wall panel assembly and/or a prefabricated modular wall structure, including glazing panels. In the present example, wall panels 206 are balloon-framed light-gauge exterior wall panels. The wall panels may be prefabricated up to a thermal break, for instance the wall panels may include sheathing and/or insulation material. Each wall panel 206 includes a plurality of parallel studs 266 and two elongate members 268. The parallel studs may be described as defining a primary wall plane of the panel. The elongate members, which may be referred to as strongbacks, collect the studs for attachment to the building frame.

Each wall panel 206 is connected to the building frame by a connection system 270. Any appropriate connection system may be used, including a system such as is described in U.S. Patent Publication No. 2018/0305925. Each wall panel may be secured to the building frame while allowing relative motion between the building frame and wall panel. The building frame may be able to move within attached wall panels in both a horizontal and a vertical direction, as required by building code. In other words, relative movement between the wall panel and the building frame may be permitted parallel to the plane of the wall panels, but prevented perpendicular to the plane of the wall panels.

Each wall panel 206 has a width 272. The width is selected to match standard spacing 216 of grid 214 of building 200, see FIG. 3. In the present example, width 272 is ten feet. This width matches standard spacing 216 of ten feet and one eighth inches with a gap for clearance loss during erection, as described above. Wall panels 206 may therefore be fully prefabricated offsite and then transported to the building site under a standard trucking permit, without need for special permits or other special provisions.

In some examples, dimensions of wall panels 206 may be multiples or fractions of standard spacing 216, to conform to deviations in grid 214. Multiple wall panels may be interchangeable and have matching dimensions, each panel may be sized and configured appropriate to a specific position, and/or any combination thereof.

Figure 11:
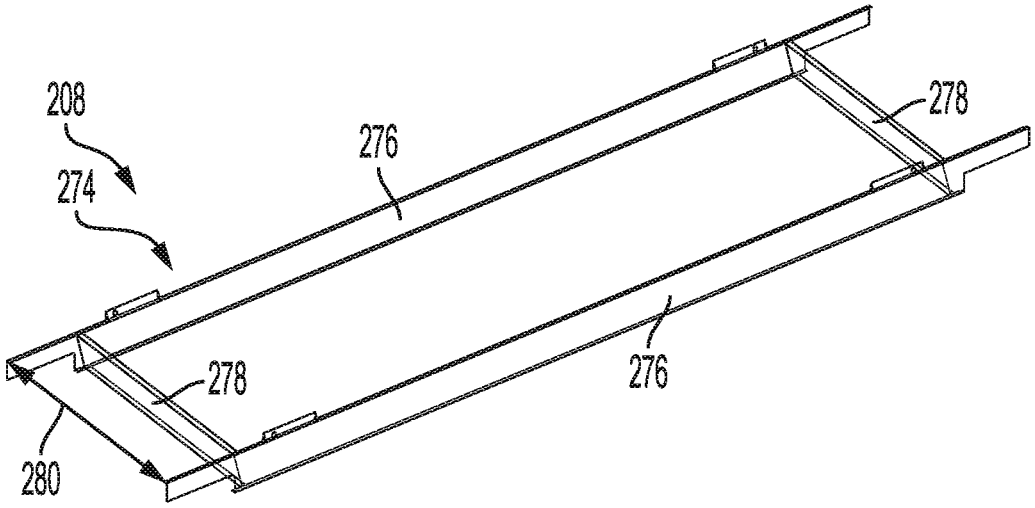
FIG. 11 is an isometric view of a roof panel of the building assembly of FIG. 2.

FIG. 11 shows a roof panel 208. Each roof panel includes a panel frame 274 and decking coupled to an outward facing edge of the frame. Decking is not pictured in FIG. 11, but can be seen in FIG. 2. The decking comprises a plurality of sections welded to the panel frame. Some sections of decking may be left un-connected during prefabrication to facilitate access to attachment points during erection. In some examples, some or all of the roof panels may be prefabricated without decking, which may instead be installed during construction of building 200.

Panel frame 26, as shown in FIG. 11, includes two parallel lateral structural members 276, and two parallel transverse structural members 278. In the present example, the lateral structural members and transverse structural members are steel C-channels, with flanges extending into an interior of panel frame 274. In some examples, I-beams or other types of flanged beams, timber beams, and/or any structurally appropriate elongate member may be used. Lateral members 276 are welded perpendicular to transverse members 278, forming a generally rectangular shape of roof panel 208. In some examples, additional structural members may be included to reinforce the frame or form another shape.

All welding of lateral members 276, transverse members 278, and/or additional structural members may be performed in the shop or factory, prior to transport of panel frame 26 to the construction site. The roof panels may also be configured to fasten to the building frame without welding, as described further below. As a consequence, the only welding required during erection of the building roof may be minimal welding of decking to a load collecting beam, to form a structural diaphragm. Such drastic reduction of welding during roof construction may reduce construction time and cost, as well as improving worker safety by limiting time spent on the roof. Accelerating the roof installation may also allow the interior of the building to be shielded from weather earlier in the construction process.

A length of lateral members 276 is selected to correspond to the distance spanned by the roof panel. A length of the transverse members 278 is selected such that an overall width 280 of roof panel 208 matches standard spacing 216 of grid 214 of building 200, see FIG. 3. In the present example, width 280 is ten feet. This width matches standard spacing 216 of ten feet and one eighth inches with a gap for clearance loss during erection, as described above. Roof panel 208 may therefore be fully prefabricated offsite and then transported to the building site under a standard trucking permit, without need for special permits or other special provisions.

In some examples, dimensions of roof panel 208 may be multiples or fractions of standard spacing 216, to conform to deviations in grid 214. Multiple roof panels may be interchangeable and have matching dimensions, each panel may be sized and configured appropriate to a specific position, and/or any combination thereof.

Roof panel 208 is connected to the building frame by a connection system. Any appropriate connection system may be used, including a system such as is described in U.S. Patent Publication No. 2018/0328034. Columns, braced frames, and/or beams of building 200 may be prefabricated to include a protruding structure having one or more apertures. As shown in FIGS. 8, 15, and 16, in the present example braced frame 203 and moment frame 207 each include a plate 257 extending from upper beam 252. Roof panel 208 may include a corresponding one or more apertures. The corresponding apertures of the building frame member and the roof panel may be configured to receive fastener assemblies, the roof panel being thereby connected to the building frame.

Plates 257 of braced frame 203 and moment frame 207 are angled relative to vertical members 248 of the frames, and are each configured to support the weight of the roof panel. In general, contact between a protruding structure of a prefabricated building frame member and a roof panel may prevent motion of the roof panel resulting from gravitational forces. A plurality of roof panels and frame members may be connected together by fastener assemblies to form the roof of the building. Each roof panel may be connected to the building frame and to one or more adjacent roof panels.

Figure 12:
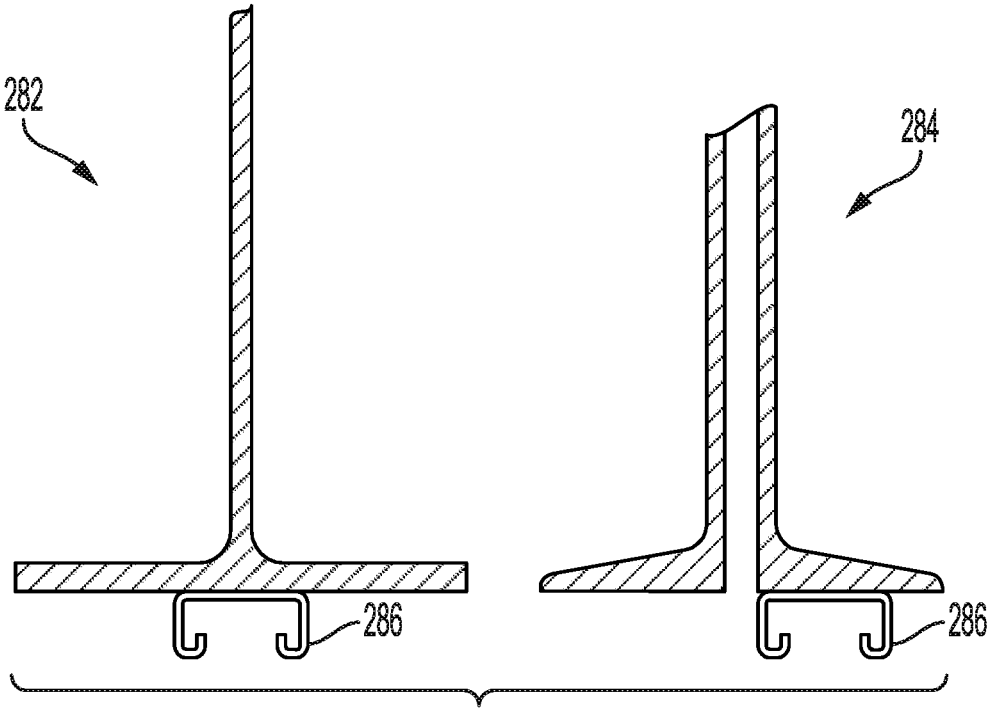
FIG. 12 is a detail view of an I-beam and C-channels of the building assembly of FIG. 2, including pre-installed Mechanical Electrical Plumbing (MEP) supports.

FIG. 12 is a detailed partial view of an I-beam 282 and a pair of c-channels 284 of the frame of building. Each of the depicted structural members includes a preinstalled Mechanical Electrical Plumbing (MEP) support 286. In the present example, each support 286 is a stainless steel strut channel, which is welded to the structural member. In general, supports 286 may include any appropriate MEP support structure, and may be attached to the structural members in any effective manner.

Supports 286 are preinstalled on selected structural members of the building frame. During design of the building, a common MEP pathway may be designated. That is, a common pathway may be defined throughout the building for MEP infrastructure. Supports 286 may be positioned along the designated pathway to facilitate installation of such infrastructure.

The selected structural members of the building frame may arrive at the building site with supports 286 already attached. The supports may be welded or otherwise connected to the structural members during off-site fabrication of the structural members. Such preinstallation may reduce on-site welding and speed construction.

Providing MEP installers with a method for connecting the infrastructure to the building structure may also minimize the need for additional in-field connections to the structure and accelerate the installation process. Providing MEP installers with a designated pathway may increase consistency through the building and facilitate future maintenance and renovation. For example, the MEP pathway may be designed such that demising walls have no conduit and plumbing through the floor, with the pathway extending through the ceiling into walls to maximize future flexibility.

Figure 17:
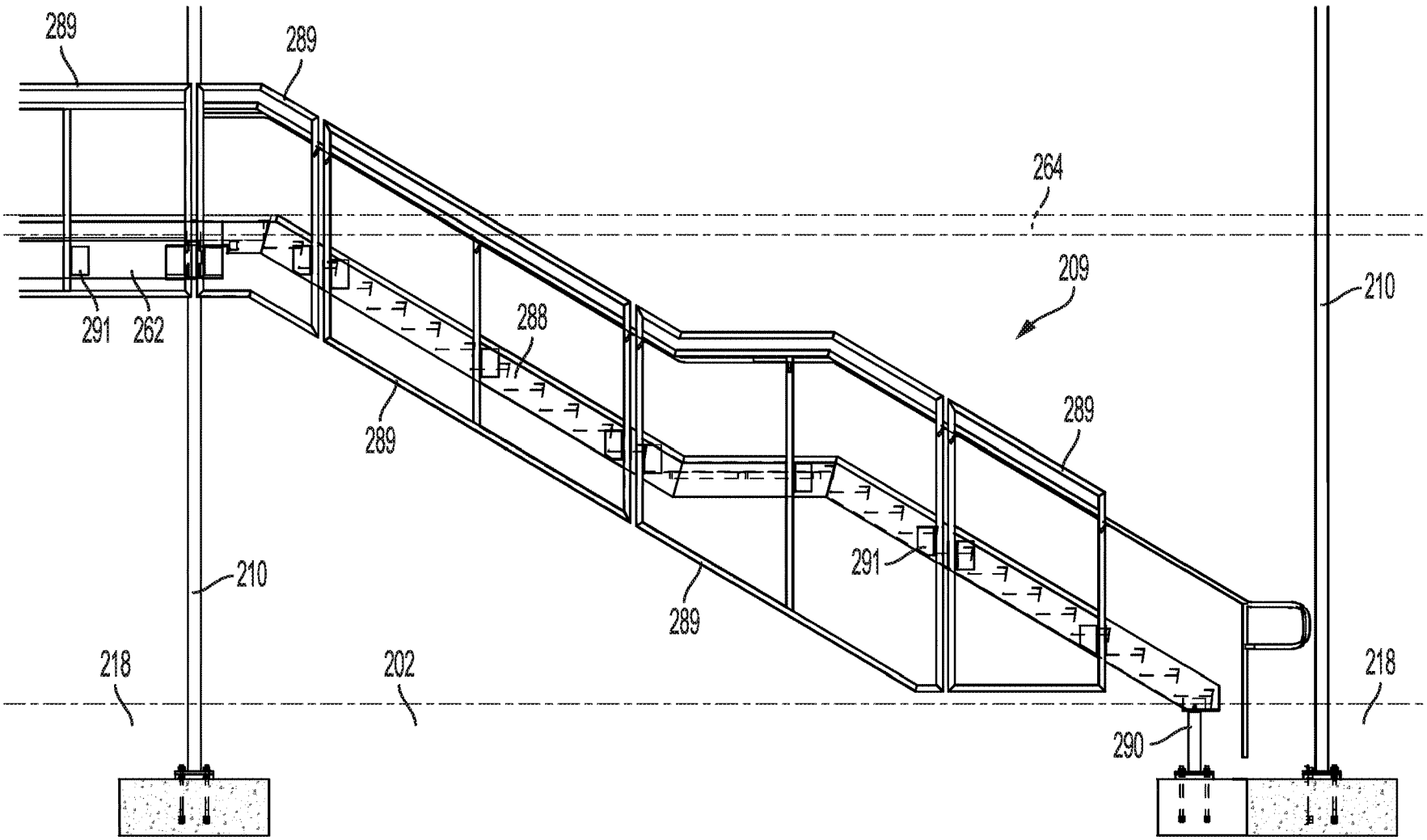
FIG. 17 is an elevation view of a staircase of the building assembly of FIG. 2.

FIG. 17 is an elevation view of a staircase system 209 of building 200. The staircase is installed between floor 264 of the second story and the floor slab of the ground floor. Staircase system 209 includes a stair assembly 288 and a plurality of guard rail panels 289. Stair assembly 288 is fastened to floor 264 and floor beam 262 at an upper end, and embedded in foundation 202 at a lower end. The stair assembly includes a support 290 at the lower end, which extends into the foundation and is bolted to a base plate. Stair assembly 288 is a single continuous prefabricated unit, which may be installed by lifting into place and fastening without need for welding.

Figure 18:
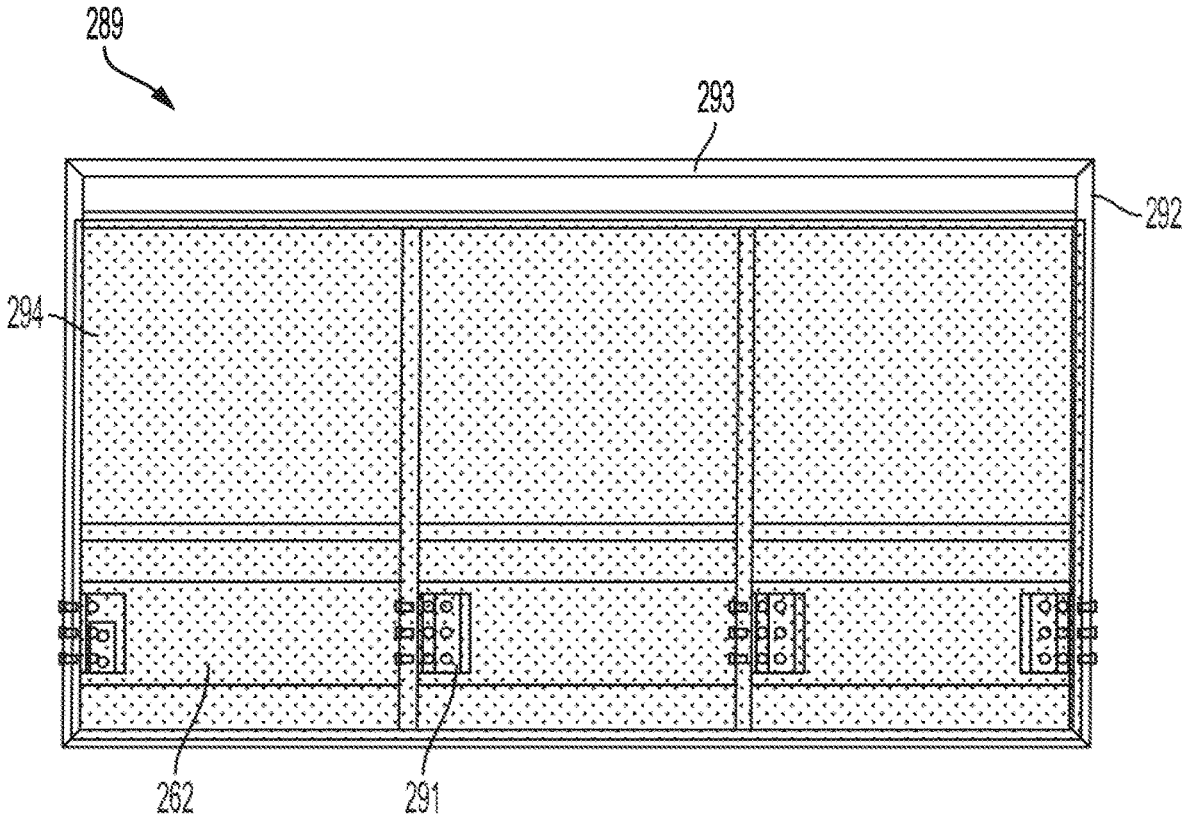
FIG. 18 is an elevation view of a guard rail panel of the staircase of FIG. 17.

Each guard rail panel is fastened to floor beam 262 and/or stair assembly 288 by one or more adjustable brackets 291. An illustrative guard rail panel 289 is shown in FIG. 18, including a frame 292 and stainless steel perforated metal facing 294. An upper grab bar 293 of the frame is spaced from facing 294, and configured for use as a handrail. Frame 292 may comprise shop-welded tube steel. Panel 289 may be sized according to industry-standard sheet sizes of the stainless steel perforated metal used to fabricated facing 294, in order to reduce and/or eliminate cutting and waste in the prefabrication of the panel. Guard rail panel may include any appropriate material or materials. The panel may be similarly configured for efficient use of any selected material. Guard rail panel 289 may be shop-fabricated and prefinished.

Figure 19:
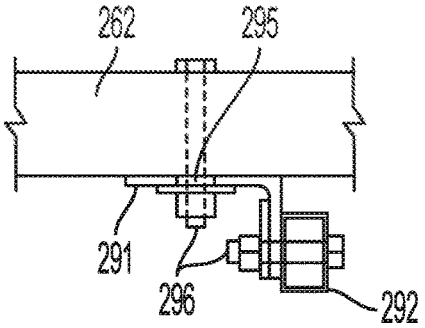
FIG. 19 is a detail plan view of a bracket of the guard rail panel of FIG. 18.
Figure 20:
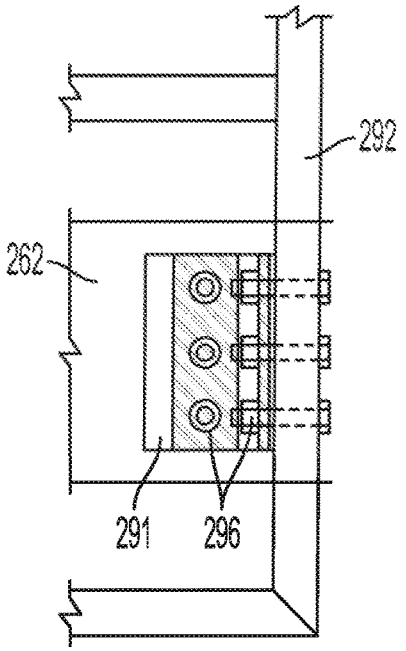
FIG. 20 is a detail elevation view of the bracket of FIG. 19.

FIGS. 19 and 20 are detailed views of an illustrative adjustable bracket 291, fastening guard rail panel 289 to floor beam 262. Adjustable brackets 291 may similarly fasten other panels to stair assembly 288, as shown in FIG. 17. Brackets 291 may be configured to allow installation of guard rail panels 289 without welding.

Adjustable bracket 291 has an L-shape, and in some examples may include an angle iron. Multiple slots 295 extend through bracket 291 to accept bolt assemblies 296. A first leg of the bracket is bolted to a vertical member of frame 292 of the guard rail panel, and a second leg of the bracket is bolted to floor beam 262. Slots 295 may be elongate, to allow adjustment of guard rail panel relative to floor beam 262. In some examples, slots on the first leg may be elongate in a vertical direction and slots on the second leg may be elongate in a horizontal direction. Such adjustment may allow a top level of adjacent guard rail panels to be aligned, facilitate precise spacing between panels, and provide simple and easy panel installation.

B. Illustrative Method of Constructing a Building

Figure 13:
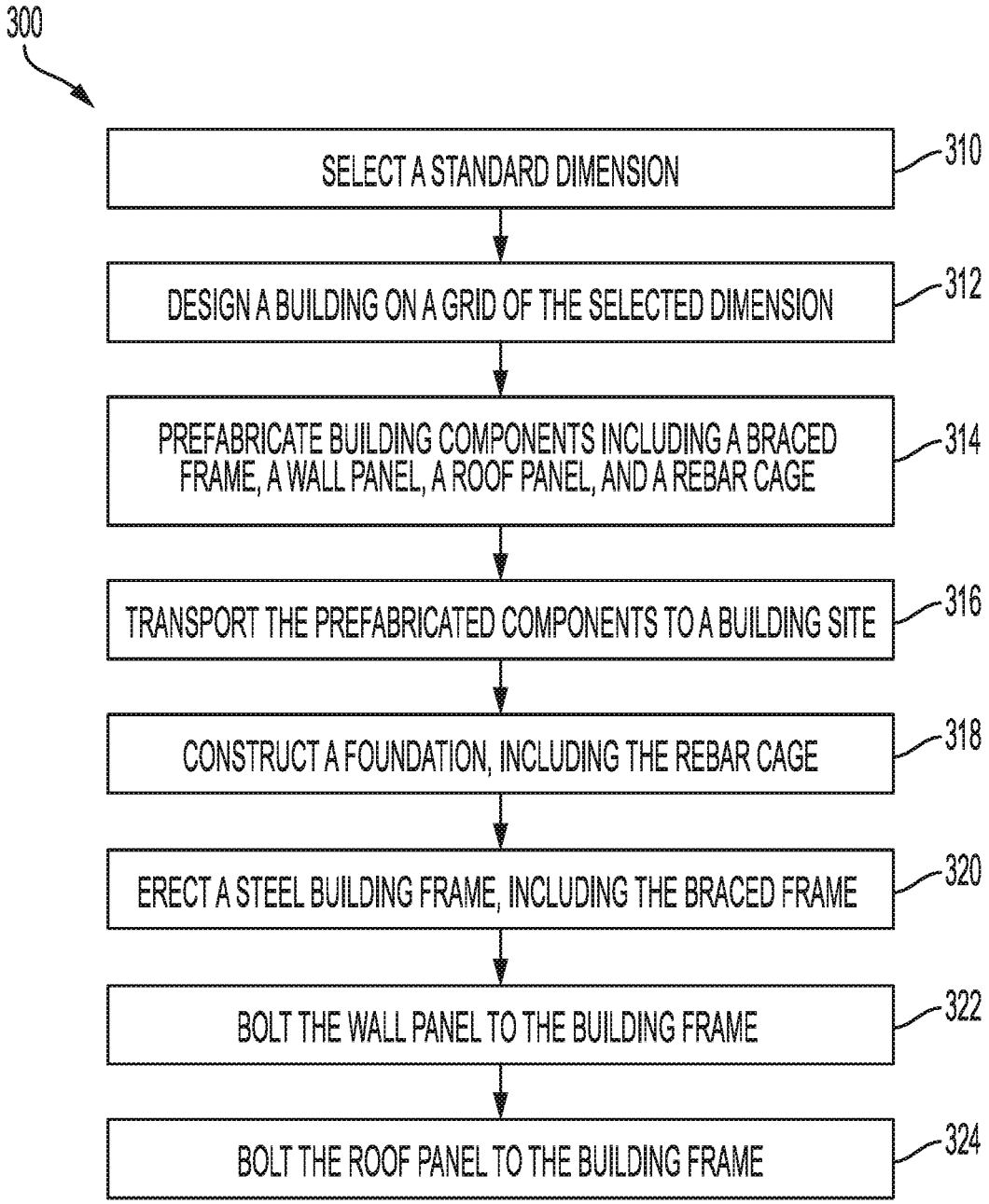
FIG. 13 is a flow chart depicting steps of an illustrative method for constructing a building according to the present teachings.

This section describes steps of an illustrative method 300 for constructing a building; see FIG. 13. Aspects of buildings and prefabricated elements described above may be utilized in the method steps described below. Where appropriate, reference may be made to components and systems that may be used in carrying out each step. These references are for illustration, and are not intended to limit the possible ways of carrying out any particular step of the method.

FIG. 13 is a flowchart illustrating steps performed in an illustrative method, and may not recite the complete process or all steps of the method. Although various steps of method 300 are described below and depicted in FIG. 13, the steps need not necessarily all be performed, and in some cases may be performed simultaneously or in a different order than the order shown.

At step 310, method 300 includes selecting a standard dimension. The standard dimension may be selected according to transportation constraints. For example, the standard dimension may be selected to be less than a standard trucking permit width limit. The standard dimension may also be selected to allow gaps to be provided between prefabricated elements. This may allow for production variation of the prefabricated elements and/or clearance loss between the prefabricated elements during erection. The standard spacing may also be selected according to design constraints of the building, such as a desired classroom size.

Step 312 of the method includes designing a building on a grid of the selected standard dimension. Foundations, structural elements, and design elements may be laid out according to the grid. For example, the foundation may include interconnecting grade beam footings, each grade beam extending along a line of the grid. For another example, columns may be located at grid intersections and braced frames may be located along grid lines.

Designing the building may also include designing a plurality of prefabricated elements. For example, the building design may include panelized walls and roof, pre-welded braced frames, and pre-tied rebar cages. Each prefabricated element may be designed to have a width corresponding to the selected standard dimension, such that all prefabricated elements are transportable by standard means. A majority of the prefabricated elements may have a standard width less than the selected standard dimension by a gap width. For example, a standard prefabricated element width may be ten feet with a gap width of one eighth inch, corresponding to a selected standard dimension of ten feet and one eight inch. For another example, a standard prefabricated element width may be eleven feet, eleven and three quarter inches with a gap width of one quarter inch, corresponding to a selected standard dimension of twelve feet.

In some examples, designing the building may include designating an MEP pathway for use by installers during construction of the building. The MEP pathway may be located to provide ease of maintenance and flexibility in adaptation or renovation of the building.

Some exceptions to the grid may be allowed in the building design, for instance for features such as a building end condition, elevator shaft, and/or oversize common space. Where exceptions to the grid are included, the building may be designed such that individual prefabricated elements used in the associated construction may still be equal to or less than the selected standard dimension.

Step 314 of the method includes prefabricating building components, including at least a braced frame, a wall panel, a roof panel, and a rebar cage. The step may further include prefabricating a plurality of each building component and/or other building components. Step 314 may be performed at a manufacturing plant, factory, or other facility appropriate for high quality manufacture of building materials under controlled conditions. Step 314 may not be performed at or adjacent a building site, for instance in a temporary structure erected for the duration of construction.

Prefabricating the building components may include performing all necessary welding, such that the building components can be assembled and/or erected without on-site welding. The prefabricated building components may be configured for bolting or fastening into place, and may be designed to reduce the number of bolts required to install each component.

Step 316 includes transporting the prefabricated components to a building site. The prefabricated components may be prefabricated in step 314 prior to beginning construction at a building site. The prefabricated components may be stored until required, and then step 316 may be performed. Transporting the prefabricated components may include trucking the components and/or transporting the components by any effective means. The prefabricated components may be configured to allow transportation under a standard trucking permit and/or by any desirable or cost effective transportation method.

Step 318 includes constructing a foundation, including the rebar cage. The rebar cage may be used in a grade beam footing, of a plurality of intersecting grade beams. Step 318 may be performed according to method 400 as described below.

Step 320 of method 300 includes erecting a steel building frame, including the braced frame. The building frame may be set into the foundation, as part of step 318. Erecting the building frame may further include bolting together structural steel members such as columns, floor and roof beams, and/or roof trusses. The building may be designed to limit or avoid welding during erection of the building frame.

Step 322 of the method includes bolting the wall panel to the building frame, and step 324 includes bolting the roof panel to the building frame. Each step may be performed according to the connection system of the respective panel. For example, step 322 may be performed according to the method described in U.S. Patent Publication No. 2018/0305925 and step 324 may be performed according to the method described in U.S. Patent Publication No. 2018/0328034.

In some examples, step 300 may further include finishing of the building. For instance, the method may include installation of floor decking and pouring of a concrete second floor. The method may include installation of interior walls, cladding of exterior walls, roofing, MEP, fire systems, and/or any desirable additional building construction.

C. Illustrative Method of Constructing a Foundation

Figure 14:
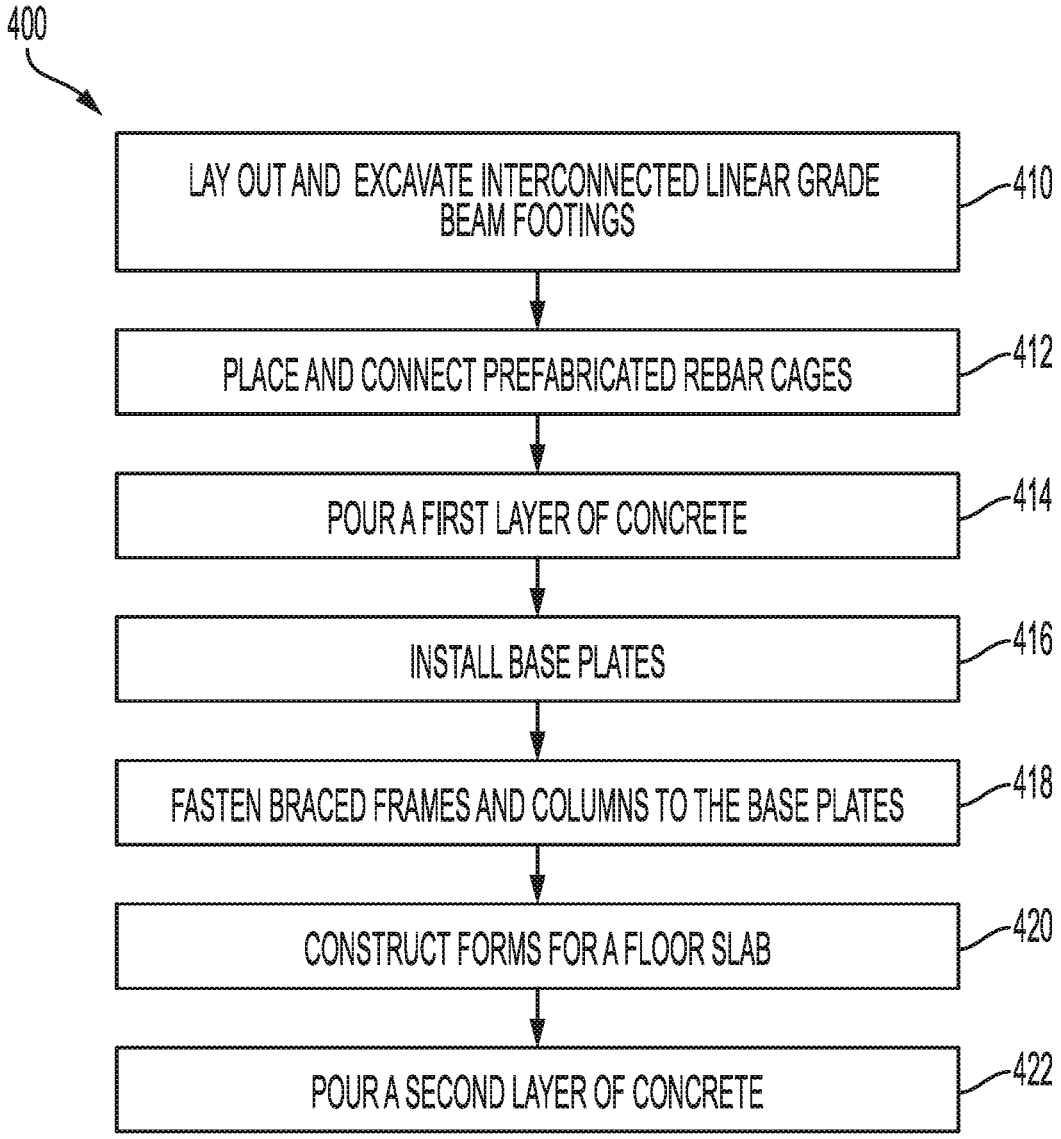
FIG. 14 is a flow chart depicting steps of constructing a building foundation according to the present teachings.

This section describes steps of an illustrative method 400 for constructing a foundation; see FIG. 14. Aspects of buildings, foundations, and prefabricated elements described above may be utilized in the method steps described below. Where appropriate, reference may be made to components and systems that may be used in carrying out each step. These references are for illustration, and are not intended to limit the possible ways of carrying out any particular step of the method.

FIG. 14 is a flowchart illustrating steps performed in an illustrative method, and may not recite the complete process or all steps of the method. Although various steps of method 400 are described below and depicted in FIG. 14, the steps need not necessarily all be performed, and in some cases may be performed simultaneously or in a different order than the order shown.

At step 410, the method includes laying out and excavating interconnected linear grade beam footings. The grade beams may each have the same width and depth, and may be limited to a depth which does not require shoring. During excavation of a trench for a grade beam, an excavator may be positioned at a first end of the trench and move down the line of the trench to a second end of the trench with a minimum of maneuvering. The trench may be dug with a single bucket.

Step 412 of method 400 includes placing and connecting prefabricated rebar cages. One or more rebar cage including lateral bars and stirrups may be prefabricated for each grade beam footing. Once the trench for the grade beam footing has been excavated, the prefabricated cage or cages may be placed into the trench. Multiple prefabricated cages within a grade beam may be connected. Similarly, where grade beams intersect and at corners, the prefabricated cages may be connected.

The foundation may be designed such that connections between rebar cages occur at points of minimum stress, allowing connections between the prefabricated rebar cages to be achieved by doweling together the cages with small bars of limited length. For example, #6 bars or smaller may be used. All dowels for the connections may be straight. The dowels needed to connect the rebar cages may be included with the prefabricated rebar cages. For example, the dowels may be wired into the cages during prefabrication and then released after the cages have been placed in the trench. Step 412 may further include positioning bolt templates.

Step 414 includes pouring a first layer of concrete. The first pour of concrete may form half, two thirds or more of the grade beam footings. In some examples, the first pour of concrete may extend up to the top of the excavated trench for the grade beam footings. The first pour of concrete may not fully cover the rebar installed in step 412. That is the rebar cages may extend above the first layer of concrete.

Step 416 includes installing base plates. Bolt templates placed in step 414 may be replaced by anchor bolts, and the base plate secured to the anchor bolts. The base plates may be positioned directly on top of the first layer of concrete and/or above the level of the first layer of concrete.

At step 418, method 400 includes fastening braced frames and columns to the base plates. The braced frames may be fully prefabricated and configured to set as columns. That is, no welding of the braced frames may be required. Each braced frame may be of a sufficiently small size to allow setting without drag anchors. The size of the braced frames may also reduce the number of bolts required to set a braced frame and the size of the base plates.

Step 420 of the method includes constructing forms for a floor slab. The forms may extend up from the soil level to the desired height of the top of the slab. The forms may extend at least above the level of the rebar cages of the grade beams.

Step 422 of the method includes pouring a second layer of concrete. The concrete may be poured into the forms constructed in step 420, to form a floor slab and complete the grade beam footings. The concrete may be poured over the base plates and bases of erected braced frames and columns, encasing the base plates and ends of the erected structures in the second layer of concrete. The building frame may be thereby directly embedded into the building foundation, providing a more reliable transfer of forces.

The second layer of concrete may form both the floor slab and a top portion of the grade beams, such that the slab and the grade beams are contiguous, with coplanar upper surfaces. The rebar cages of the grade beam footings may also extend up into the second layer of concrete, which may mobilize the slab as part of the foundation.

Method 400 may allow quick and efficient construction of a foundation. The linear design of the grade beam footings, pre-tied rebar cages, pre-assembled braced frames, and two-pour system may allow the trenches to be dug quickly, rebar to be installed quickly, and concrete poured quickly. The method may therefore be overall faster, more efficient and less susceptible to weather. Method 400 may also result in a more economical and robust foundation with improved structural integrity.

Illustrative Combinations and Additional Examples

This section describes additional aspects and features of buildings and methods of constructing a building, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. A method of constructing a building, including:

selecting a standard dimension which is less than a wide-load trucking permit limit, designing a building on a grid defined by the selected standard dimension, the building including a plurality of prefabricated elements, wherein each prefabricated element has a width corresponding to the selected standard dimension, and the plurality of prefabricated elements includes:

a wall panel including a plurality of vertical studs connected to a strongback and a sheathing material, a roof panel including a first pair of parallel structural members, a second pair of parallel structural members extending between the first pair of parallel structural members, and a decking material, a braced frame, and a rebar cage, fabricating each of the plurality of prefabricated elements at a manufacturing plant;

transporting the plurality of prefabricated elements by truck from the manufacturing plant to a building site, constructing intersecting grade beam footings at the building site, the grade beam footings having a uniform width and depth and including the rebar cage, and, pouring a slab between the intersecting grade beam footings, wherein the grade beam footings and slab have contiguous coplanar upper surfaces.

A1. The method of A0, wherein the constructing step includes:

pouring a first layer of concrete over the rebar cage, installing a plate on top of the first layer, fastening the braced frame to the plate, and pouring a second layer of concrete over the plate.

A2. The method of A0 or A1, further comprising:

erecting and bolting together pre-welded components, including the braced frame, to form a steel building frame.

A3. The method of A2, further comprising:

bolting the wall panel to the steel building frame.

A4. The method of A2 or A3, further comprising:

bolting the roof panel to the steel building frame.

A5. The method of any of A0-A4, wherein the standard dimension is less than 11 feet.

A6. The method of any of A1-A5, wherein the rebar cage includes a stirrup that extends into the second layer of concrete.

A7. The method of any of A1-A6, wherein the second layer of concrete is contiguous with the slab.

B0. A method of constructing a building, comprising:

prefabricating a braced frame including a column component and a diagonal brace component, prefabricating a rebar cage, transporting the braced frame and the rebar cage to a construction site, constructing intersecting grade beam footings at the construction site, the grade beam footings having a uniform width and depth and including the rebar cage, wherein the column component of the braced frame extends into at least one of the grade beam footings.

B1. The method of B0, further comprising:

pouring a concrete slab at the same height as the grade beam footings.

B2. The method of B0 or B1, wherein the constructing step includes:

pouring a first layer of concrete over the rebar cage, installing a plate on top of the first layer, fastening the braced frame to the plate, and pouring a second layer of concrete over the plate.

B3. The method of any of B0-B2, further comprising:

erecting and bolting together pre-welded components, including the braced frame, to form a steel building frame.

B4. The method of B3, further comprising:

bolting a panelized wall component to the steel building frame.

B5. The method of B3 or B4, further comprising:

bolting a panelized roof component to the steel building frame.

C0. A building assembly, comprising: a foundation including intersecting grade beam footings having a uniform width and depth, and a slab extending between grade beam footings, wherein the slab and grade beam footings have coplanar upper surfaces.

C1. The building assembly of C0, wherein the grade beam footings and the slab are contiguous.

C2. The building assembly of C0 or C1, wherein the grade beam footings include prefabricated rebar cages.

C3. The building assembly of C2, wherein the grade beam footings include a first layer of concrete and a second layer of concrete, the rebar cages extending into the second layer of concrete.

C4. The building assembly of C3, further comprising:

a prefabricated braced frame including a column component and a diagonal brace component, the column component extending into the second layer of concrete in the grade beam footings.

C5. The building assembly of C4, wherein the column component of the braced frame is connected to a plate sandwiched between the first and second layers of concrete in the grade beam footings.

C6. The building assembly of any of C0-C5, wherein the entire foundation has the same depth.

D0. A building, comprising:

linear footings laid out on a grid and including prefabricated linear rebar cages and grade beams, wherein the top of the grade beam is at approximately the top of the footing slab;

prefabricated structural steel braced frames having a width of 10 feet or smaller, embedded directly into the grade beams;

prefabricated wall panels having a width of 10 feet or smaller, with strongback connections to the building;

prefabricated roof panels having a width of 10 feet or smaller, with permanent fall protection points; and a designated common Mechanical Electrical and Plumbing (MEP) pathway with points of connection for MEP infrastructure.

Advantages, Features, and Benefits

The different examples of the construction methods and buildings described herein provide several advantages over known solutions for constructing a building. For example, illustrative examples described herein dramatically reduce construction time and improve on site construction efficiency.

Additionally, and among other benefits, illustrative examples described herein allow improved precision in fabrication of building materials, resulting in higher overall building quality and improved safety.

Additionally, and among other benefits, illustrative examples described herein reduce and/or eliminate field welding, which shortens the on-site construction timeline and lowers costs.

Additionally, and among other benefits, illustrative examples described herein provide efficient foundations with improved structural integrity.

Additionally, and among other benefits, illustrative examples described herein increase building frame redundancy and therefore improve structural integrity.

Additionally, and among other benefits, illustrative examples described herein facilitate incorporation of predesigned and/or commercially available prefabricated elements and/or systems.

No known system or device can perform these functions, particularly for such a wide range of building designs. The illustrative examples described herein are particularly useful for building with standardized floor plans. However, not all exampled described herein provide the same advantages or the same degree of advantage.

CONCLUSION

The disclosure set forth above may encompass multiple distinct examples with independent utility. Although each of these has been disclosed in its preferred form(s), the specific examples thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A method of constructing a building, including:

selecting a standard dimension which is less than a wide-load trucking permit limit, designing a building on a grid defined by the selected standard dimension, the building including a foundation and a plurality of prefabricated elements, wherein each prefabricated element has a width corresponding to the selected standard dimension, and the plurality of prefabricated elements includes:

wall panels, roof panels, pre-welded components including laterally resistive frames, and rebar cages, fabricating each of the plurality of prefabricated elements at a manufacturing plant, including welding the pre-welded components;

transporting the plurality of prefabricated elements by truck from the manufacturing plant to a building site, and assembling the plurality of prefabricated elements at the building site, without welding, including:

positioning the rebar cage in the foundation, erecting and bolting together the pre-welded components, to form a steel building frame, bolting the wall panel to the steel building frame, and bolting the roof panel to the steel building frame.

2. The method of claim 1, wherein a least a portion of the fabricating step is completed prior to breaking ground at the building site.

3. The method of claim 1, wherein fabricating the rebar cages includes cutting connecting bars and including the connecting bars with the rebar cages for transportation, and assembling the rebar cages includes doweling together the rebar cages with the connecting bars.

4. The method of claim 1, wherein the assembling step includes setting the laterally resistive frames in footings without drag anchors.

5. The method of claim 1, wherein the designing step includes locating each included column on an intersection of lines of the grid, and locating each laterally resistive frame to extend between two intersections of lines of the grid.

6. The method of claim 5, wherein the designing step further includes locating a plurality of intersecting grade beam footings along lines of the grid.

7. The method of claim 1, wherein the selected standard dimension is greater than the width of the prefabricated wall panels and roof panels, and the assembling step includes allowing gaps between erected panels.

8. The method of claim 7, further including sealing any gaps remaining after the assembling step.

9. A method of constructing a building, including:

selecting a standard dimension which is less than a wide-load trucking permit limit, designing a building on a grid defined by the selected standard dimension, the building including a foundation and a plurality of prefabricated elements, wherein each prefabricated element has a width corresponding to the selected standard dimension, and the plurality of prefabricated elements includes:

a wall panel including a plurality of vertical studs connected to a strongback and a sheathing material, a roof panel including a first pair of parallel structural members, a second pair of parallel structural members extending between the first pair of parallel structural members, and a decking material, pre-welded components including a laterally resistive frame, and a rebar cage, fabricating each of the plurality of prefabricated elements at a manufacturing plant, including welding the pre-welded components;

transporting the plurality of prefabricated elements by truck from the manufacturing plant to a building site, and assembling the plurality of prefabricated elements at the building site, including:

positioning the rebar cage in the foundation, erecting and bolting together the pre-welded components, to form a steel building frame, bolting the wall panel to the steel building frame, and bolting the roof panel to the steel building frame.

10. The method of claim 9, wherein the standard dimension is less than 11 feet.

11. The method of claim 9, wherein the assembling step does not include welding.

12. The method of claim 9, wherein bolting the wall panel to the steel frame includes bolting the strongback of the wall panel to a structural member of the steel frame.

13. The method of claim 9, wherein bolting the roof panel to the steel building frame includes bolting the roof panel to an angled plate fixed to a structural member of the steel frame.

14. The method of claim 9, wherein the decking material of the roof panel is comprised of a plurality of sections, at least one of which is welded to the first pair of parallel structural members of the roof panel.

15. The method of claim 9, wherein bolting the wall panel to the steel building frame consists of bolting the strongback to the steel building frame.

16. The method of claim 15, wherein the wall panel is prefabricated up to a thermal break.

17. The method of claim 9, further comprising:

constructing intersecting grade beam footings at the building site, the grade beam footings having a uniform width and depth and including the rebar cage, and, pouring a slab between the intersecting grade beam footings, wherein the grade beam footings and the slab have contiguous coplanar upper surfaces.

18. The method of claim 17, wherein the constructing step includes:

pouring a first layer of concrete over the rebar cage, installing a plate on top of the first layer, fastening the laterally resistive frame to the plate, and pouring a second layer of concrete over the plate.

19. The method of claim 18, wherein the rebar cage includes a stirrup that extends into the second layer of concrete.

* * * * *